US007715282B2

(12) United States Patent
Driska

(10) Patent No.: US 7,715,282 B2
(45) Date of Patent: May 11, 2010

(54) SINGLE DAY ALARM CLOCK

(75) Inventor: John J. Driska, Rahway, NJ (US)

(73) Assignee: SDI Technologies Inc., Rahway, NJ (US)

( * ) Notice: Subject to any disclaimer, the term of this patent is extended or adjusted under 35 U.S.C. 154(b) by 0 days.

(21) Appl. No.: 11/426,131

(22) Filed: Jun. 23, 2006

(65) Prior Publication Data

US 2007/0019508 A1 Jan. 25, 2007

(51) Int. Cl.
*G04C 21/00* (2006.01)
*G04C 23/00* (2006.01)

(52) U.S. Cl. ..... 368/74; 368/250

(58) Field of Classification Search ..... 368/10, 368/72–73, 187, 250, 251
See application file for complete search history.

(56) References Cited

U.S. PATENT DOCUMENTS

| | | | | |
|---|---|---|---|---|
| 3,953,963 | A * | 5/1976 | Nishimura et al. | 368/159 |
| 4,084,104 | A | 4/1978 | Scherer | |
| 4,090,353 | A | 5/1978 | Maeda et al. | |
| 4,095,410 | A * | 6/1978 | Kaneko | 368/73 |
| 4,099,371 | A * | 7/1978 | Mochizuki et al. | 368/249 |
| 4,107,916 | A | 8/1978 | Kondo | |
| 4,187,468 | A | 2/1980 | Kao | |
| 4,202,235 | A | 5/1980 | Namiki et al. | |
| 4,421,418 | A * | 12/1983 | Morishima | 368/69 |
| 4,487,512 | A | 12/1984 | Price | |
| 4,731,765 | A * | 3/1988 | Cole et al. | 368/10 |
| 5,089,998 | A * | 2/1992 | Rund | 368/72 |
| 5,365,494 | A | 11/1994 | Lynch | |
| 5,559,762 | A * | 9/1996 | Sakamoto | 368/74 |
| 5,886,952 | A | 3/1999 | White | |
| 6,678,215 | B1 | 1/2004 | Treyz et al. | |
| 6,967,900 | B2 * | 11/2005 | Chapman | 368/10 |
| 2004/0151076 | A1 | 8/2004 | Fidel | |
| 2005/0174889 | A1 | 8/2005 | Marcantonio et al. | |
| 2005/0190654 | A1 | 9/2005 | Patel | |

* cited by examiner

*Primary Examiner*—Vit W Miska
(74) *Attorney, Agent, or Firm*—Arent Fox LLP

(57) ABSTRACT

A single day alarm clock includes circuitry for selecting an alarm mode to be an alarm-on mode or an alarm-off mode, circuitry for setting an alarm time at which an alarm will sound when the alarm mode is set to the alarm-on mode and circuitry for automatically setting the alarm mode to the alarm-off mode once the alarm has sounded in the alarm-on mode, thereby preventing the alarm from sounding the next day at the set alarm time.

14 Claims, 19 Drawing Sheets

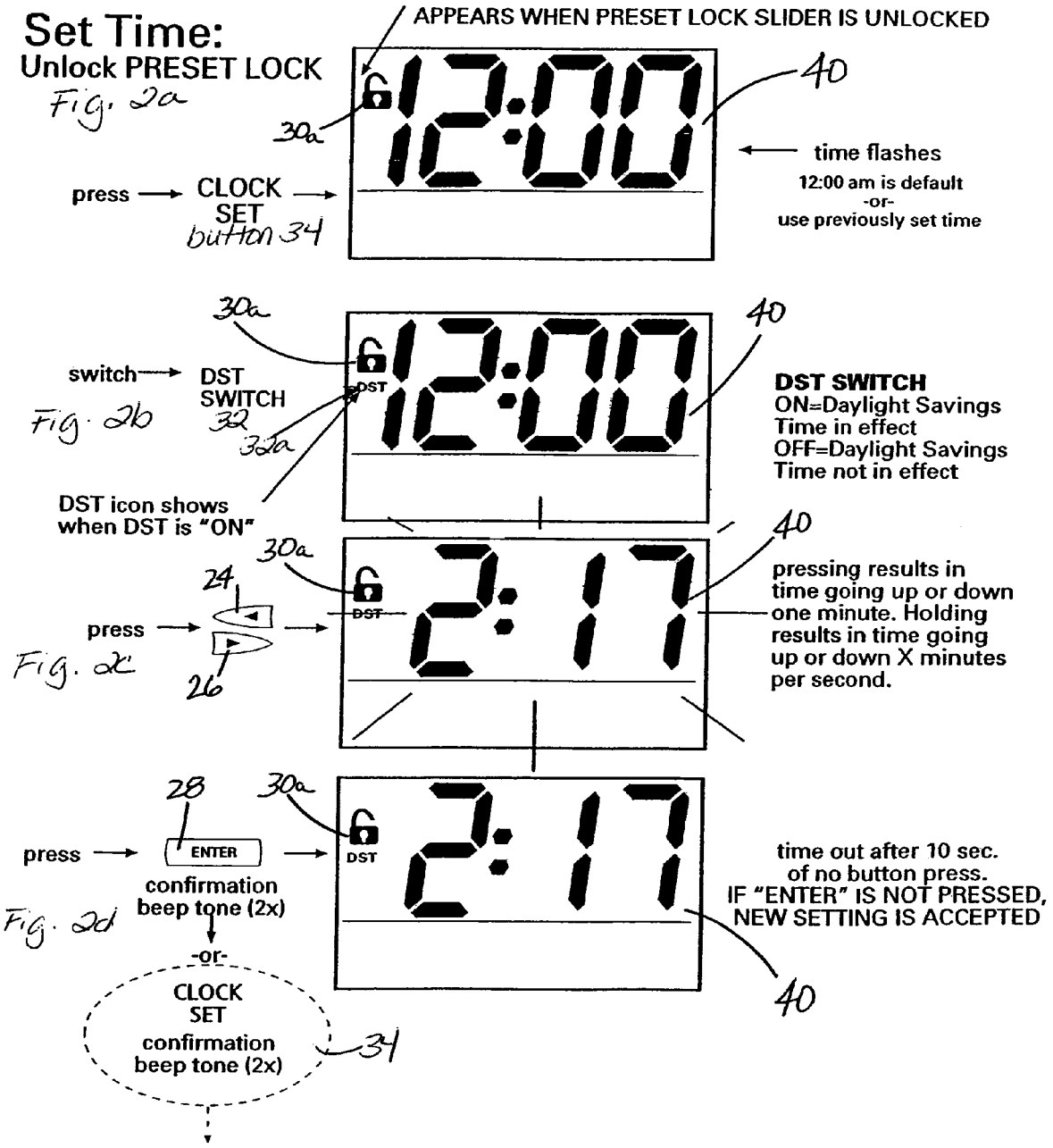
Set Time:
Unlock PRESET LOCK
Fig. 2a
APPEARS WHEN PRESET LOCK SLIDER IS UNLOCKED
30a
12:00
40
time flashes
12:00 am is default
-or-
use previously set time
press
CLOCK SET
button 34
switch
DST SWITCH
32
32a
Fig. 2b
DST
DST icon shows when DST is "ON"
DST SWITCH
ON=Daylight Savings Time in effect
OFF=Daylight Savings Time not in effect
24
26
press
Fig. 2c
2:17
pressing results in time going up or down one minute. Holding results in time going up or down X minutes per second.
28
ENTER
press
confirmation beep tone (2x)
Fig. 2d
-or-
CLOCK SET confirmation beep tone (2x)
34
time out after 10 sec. of no button press.
IF "ENTER" IS NOT PRESSED, NEW SETTING IS ACCEPTED

Set Presets
move PRESET LOCK slide switch to the "Unlocked" position
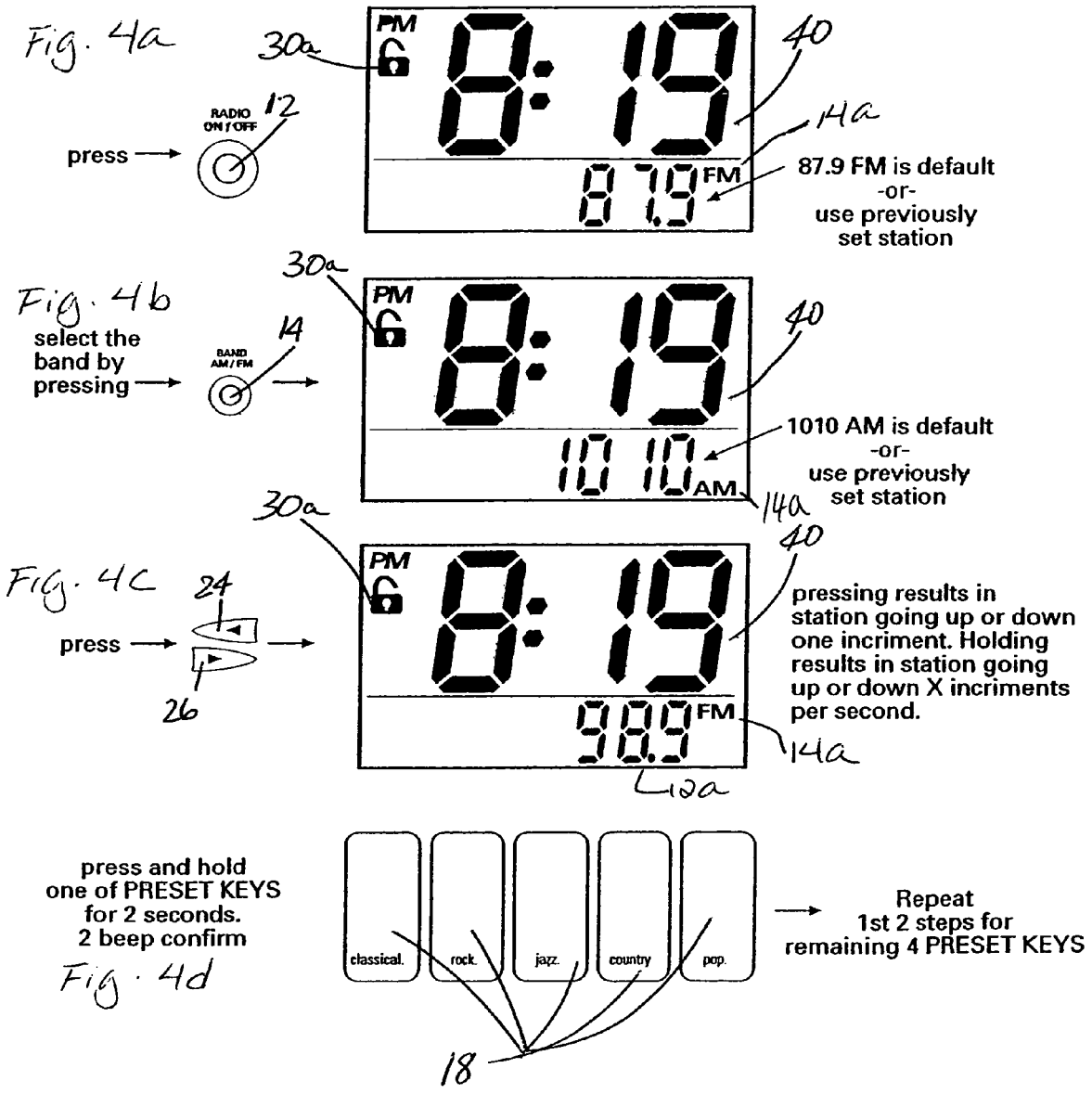

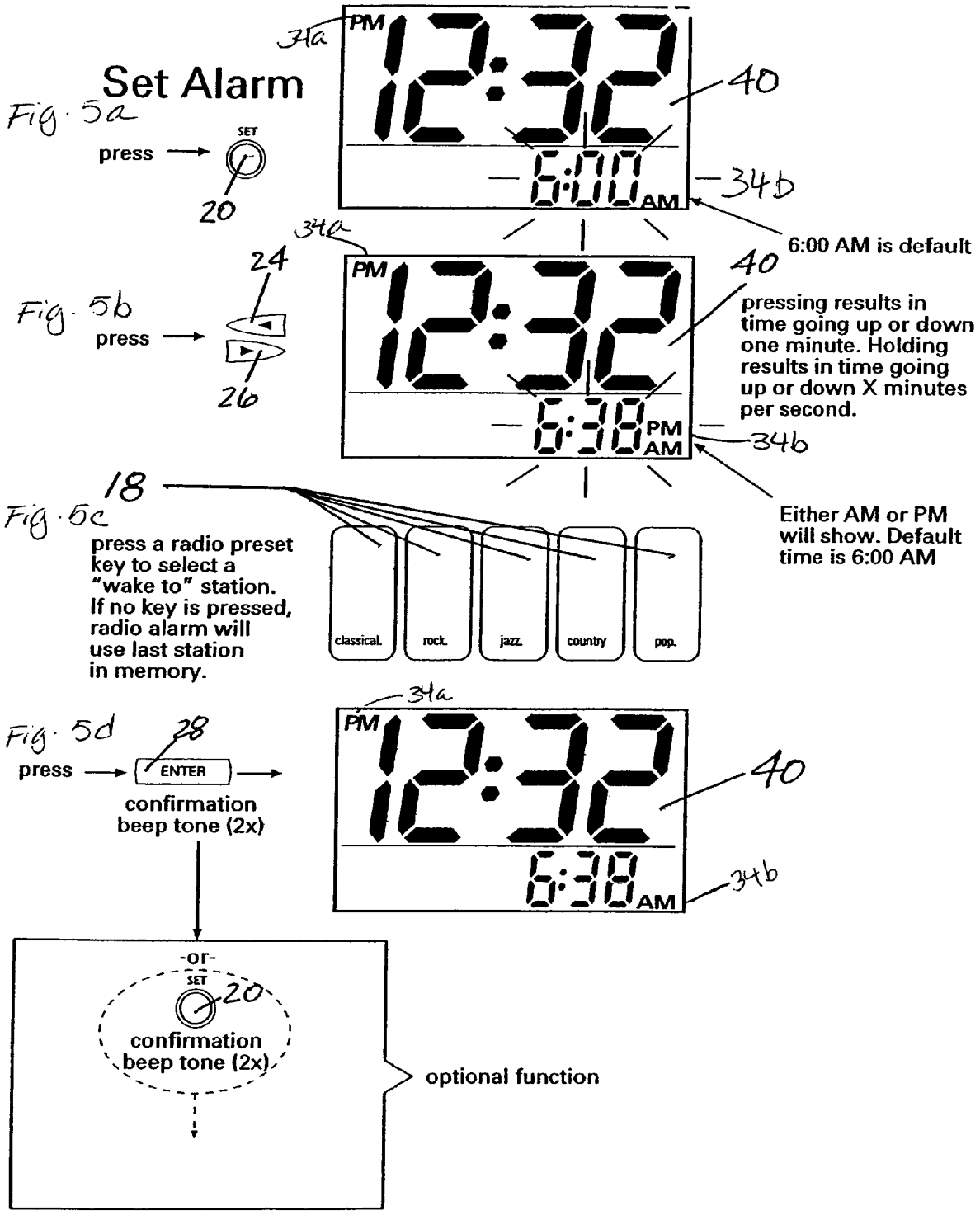
Set Alarm
Fig. 5a
press
SET
20
34a
PM
12:32
40
6:00
AM
34b
6:00 AM is default
Fig. 5b
press
24
26
34a
PM
12:32
40
6:38
PM
AM
34b
pressing results in time going up or down one minute. Holding results in time going up or down X minutes per second.
Either AM or PM will show. Default time is 6:00 AM
18
Fig. 5c
press a radio preset key to select a "wake to" station. If no key is pressed, radio alarm will use last station in memory.
classical.
rock.
jazz.
country
pop.
Fig. 5d
28
press
ENTER
confirmation beep tone (2x)
34a
PM
12:32
40
6:38
AM
34b
-or-
SET
20
confirmation beep tone (2x)
optional function

Selecting Alarm Mode:

(radio preset / buzzer/alarm off)

By defaut, the alarm is off after completing steps on page 4 radio alarm sounds 90 minutes if not in snooze at preset station conditions as defined on page 4 buzzer will sound for 90 minutes or until an action is taken on page 6 no alarm will sound

Stopping Alarm after alarm has gone off (in either radio or buzzer mode), pressing either of the following keys will deactivate the alarm:

Snooze Bar

NOTE: After alarm has gone off, alarm mode defaults to "ALARM OFF"

Clock Dimmer/ Night Light (optional)

Radio Tuning
steps are non-sequential. Radio must be on for this function.
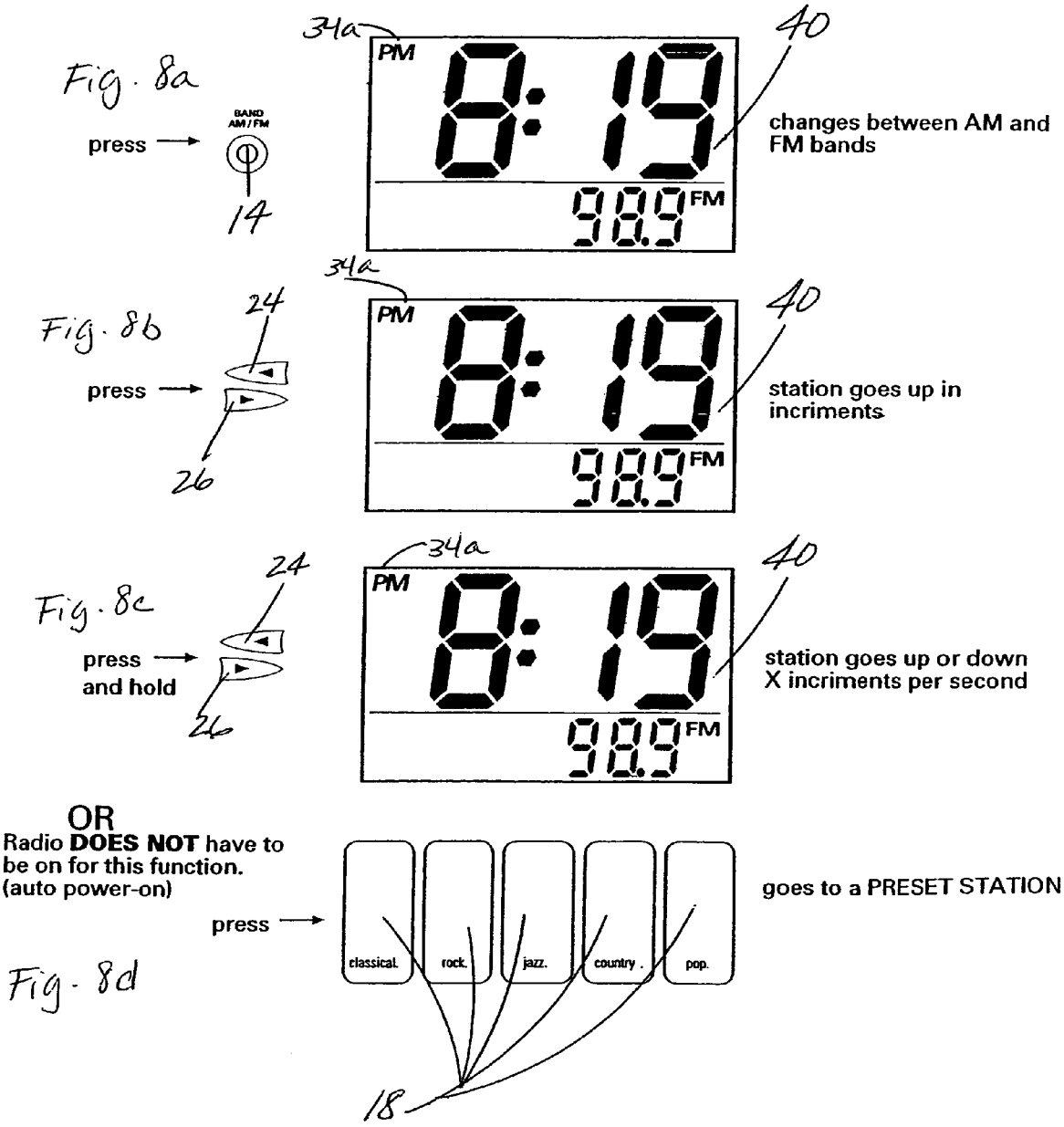

Factory Preset Clock,
Auto DST/Leap Year

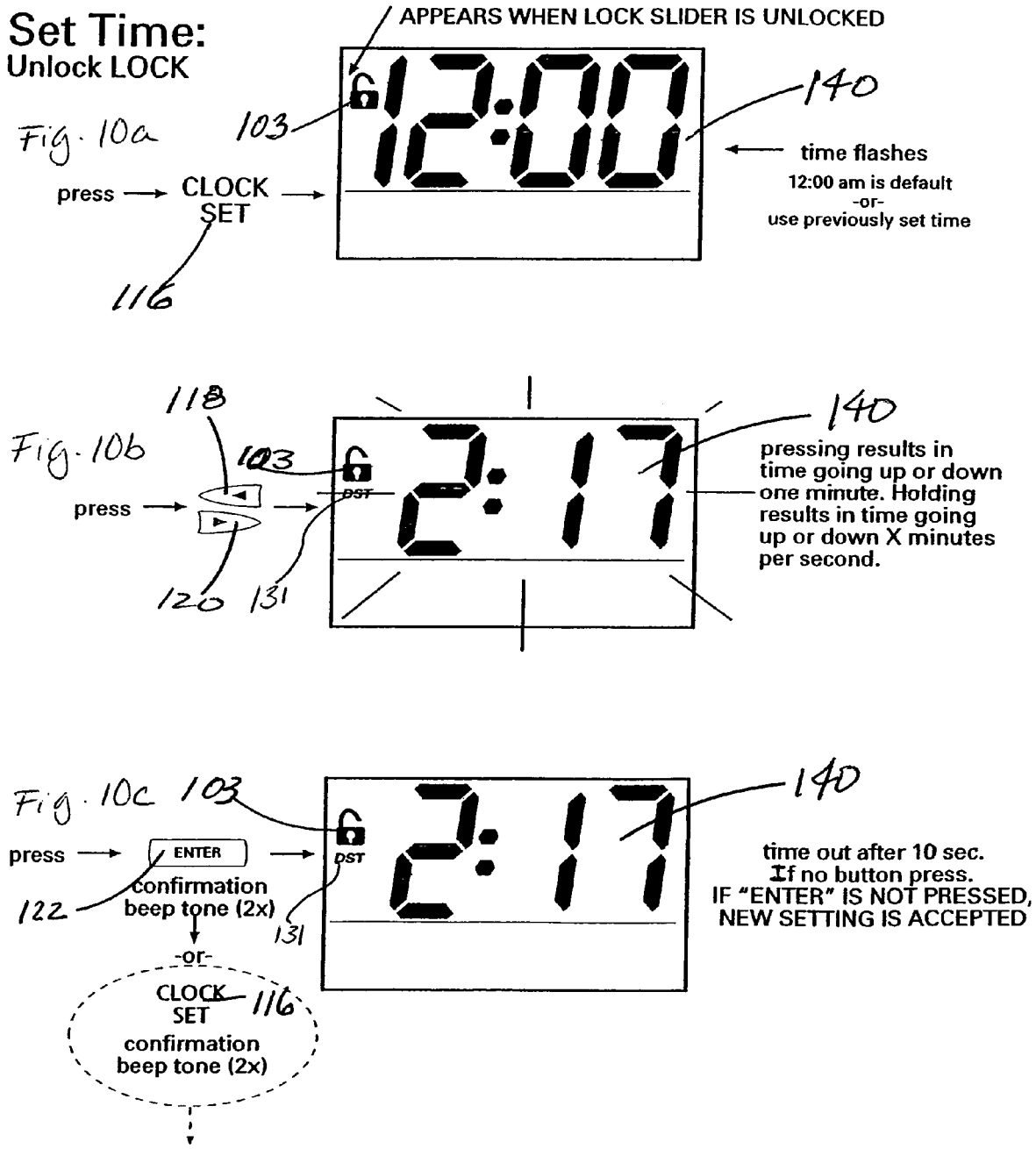
Set Time:
Unlock LOCK
Fig. 10a
APPEARS WHEN LOCK SLIDER IS UNLOCKED
103
12:00
140
time flashes
12:00 am is default
-or-
use previously set time
press
CLOCK SET
116
Fig. 10b
118
103
2:17
140
pressing results in time going up or down one minute. Holding results in time going up or down X minutes per second.
press
DST
120
131
Fig. 10c
103
2:17
140
press
ENTER
DST
122
confirmation beep tone (2x)
131
-or-
CLOCK SET
116
confirmation beep tone (2x)
time out after 10 sec. If no button press.
IF "ENTER" IS NOT PRESSED, NEW SETTING IS ACCEPTED

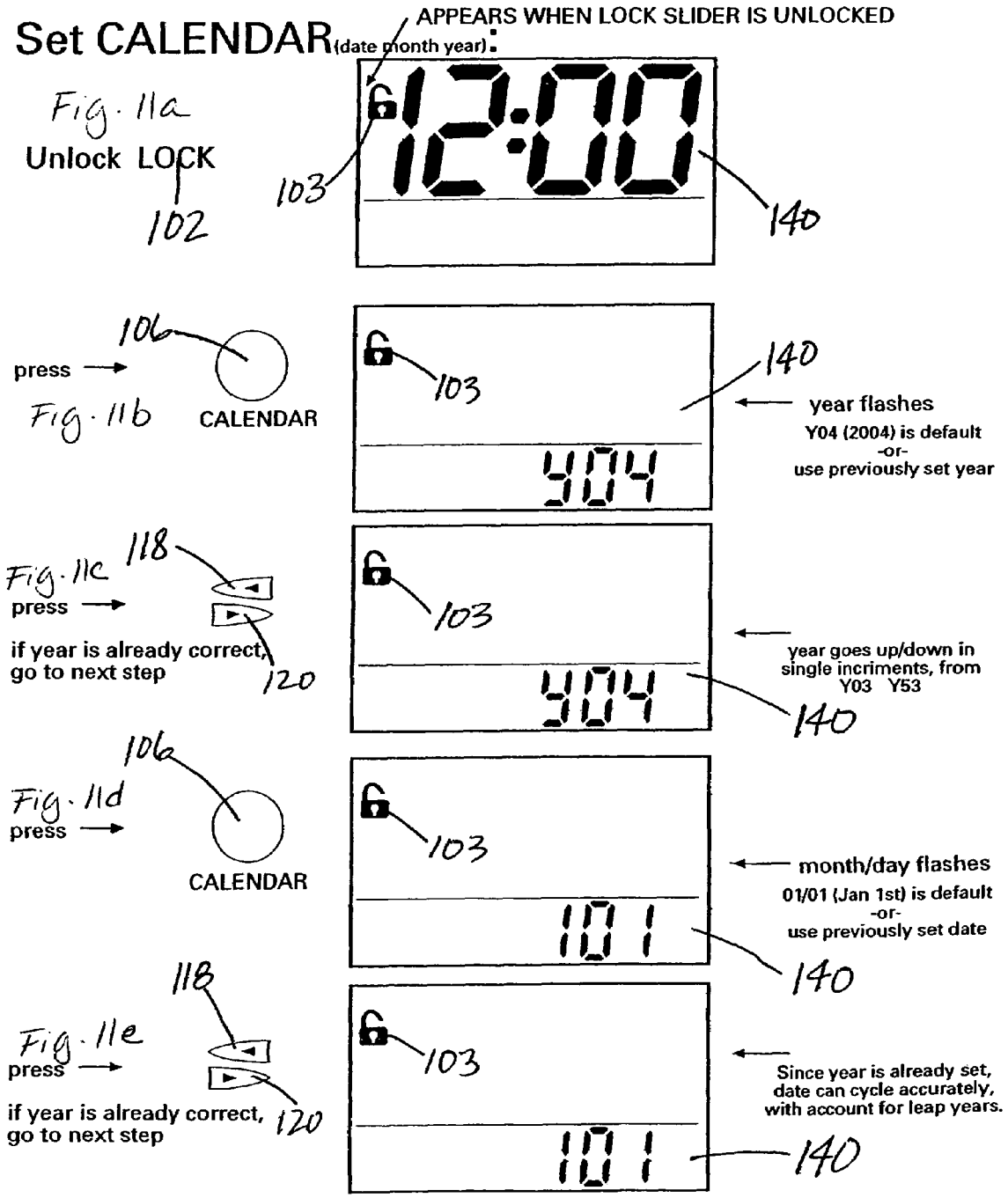
Set CALENDAR (date month year):
APPEARS WHEN LOCK SLIDER IS UNLOCKED
Fig. 11a
Unlock LOCK
102
103
12:00
140
106
press
Fig. 11b
CALENDAR
103
140
Y04
year flashes
Y04 (2004) is default
-or-
use previously set year
118
Fig. 11c
press
if year is already correct, go to next step
120
103
Y04
140
year goes up/down in single incriments, from Y03 Y53
106
Fig. 11d
press
CALENDAR
103
101
140
month/day flashes
01/01 (Jan 1st) is default
-or-
use previously set date
118
Fig. 11e
press
if year is already correct, go to next step
120
103
101
140
Since year is already set, date can cycle accurately, with account for leap years.

Set Presets
move LOCK slide switch to the "Unlocked" position
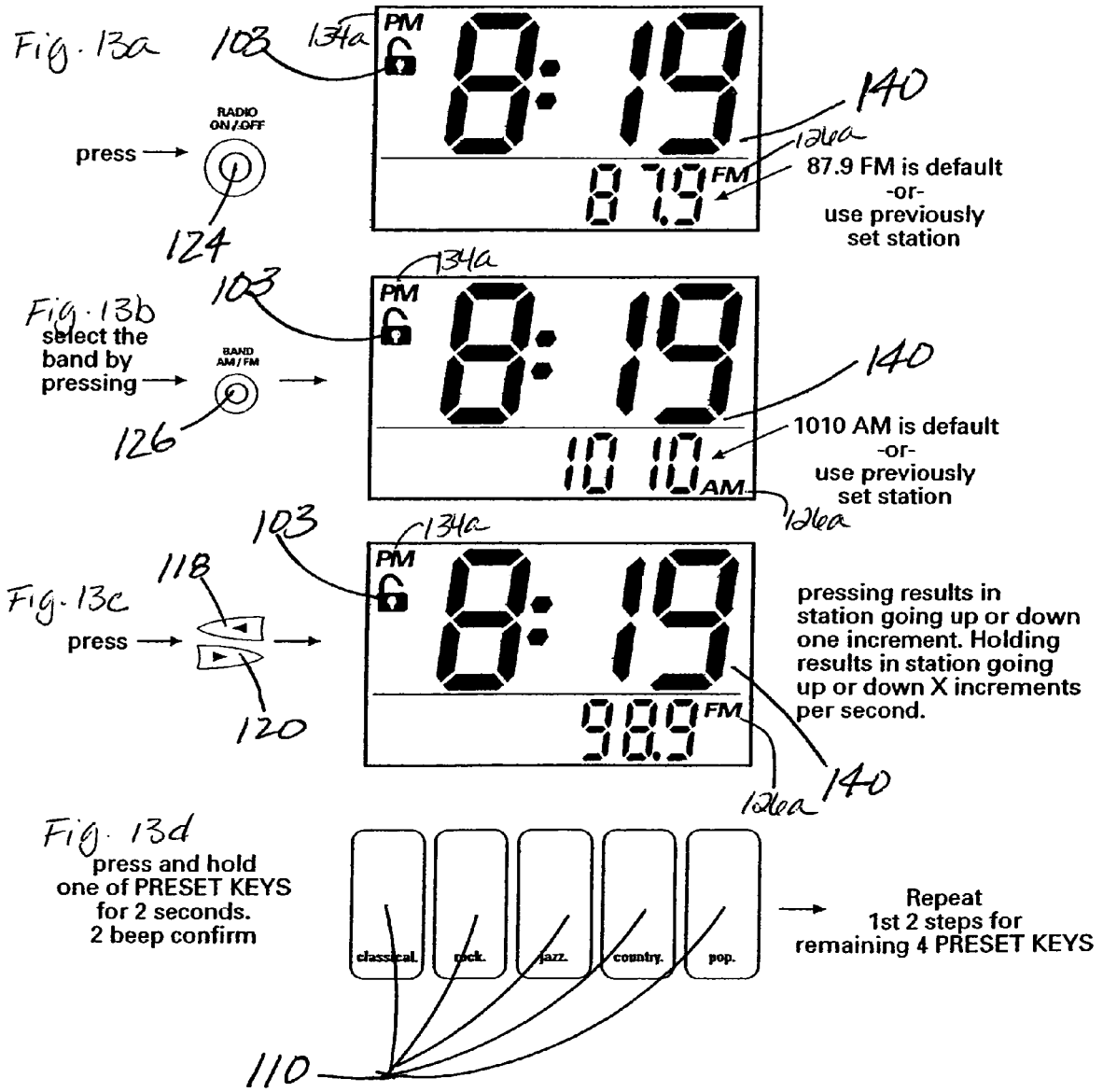

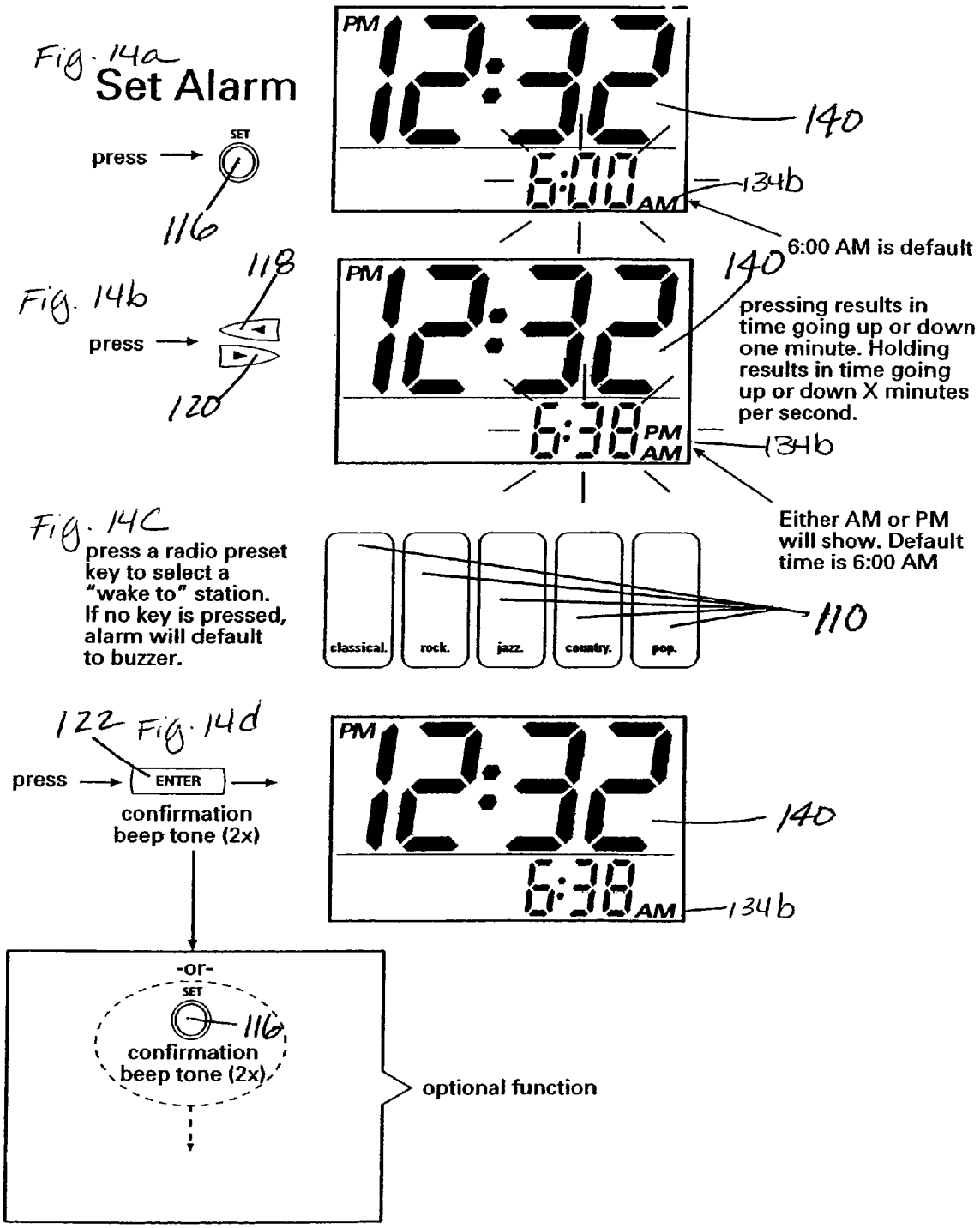
Fig. 14a
Set Alarm
press
SET
116
PM
12:32
6:00 AM
140
134b
6:00 AM is default
Fig. 14b
118
press
120
PM
12:32
6:38 PM AM
140
pressing results in time going up or down one minute. Holding results in time going up or down X minutes per second.
134b
Either AM or PM will show. Default time is 6:00 AM
Fig. 14C
press a radio preset key to select a "wake to" station. If no key is pressed, alarm will default to buzzer.
classical.
rock.
jazz.
country.
pop.
110
122 Fig. 14d
press
ENTER
confirmation beep tone (2x)
PM
12:32
6:38 AM
140
134b
-or-
SET
116
confirmation beep tone (2x)
optional function

Selecting Alarm Mode:
(radio preset / buzzer / alarm off)
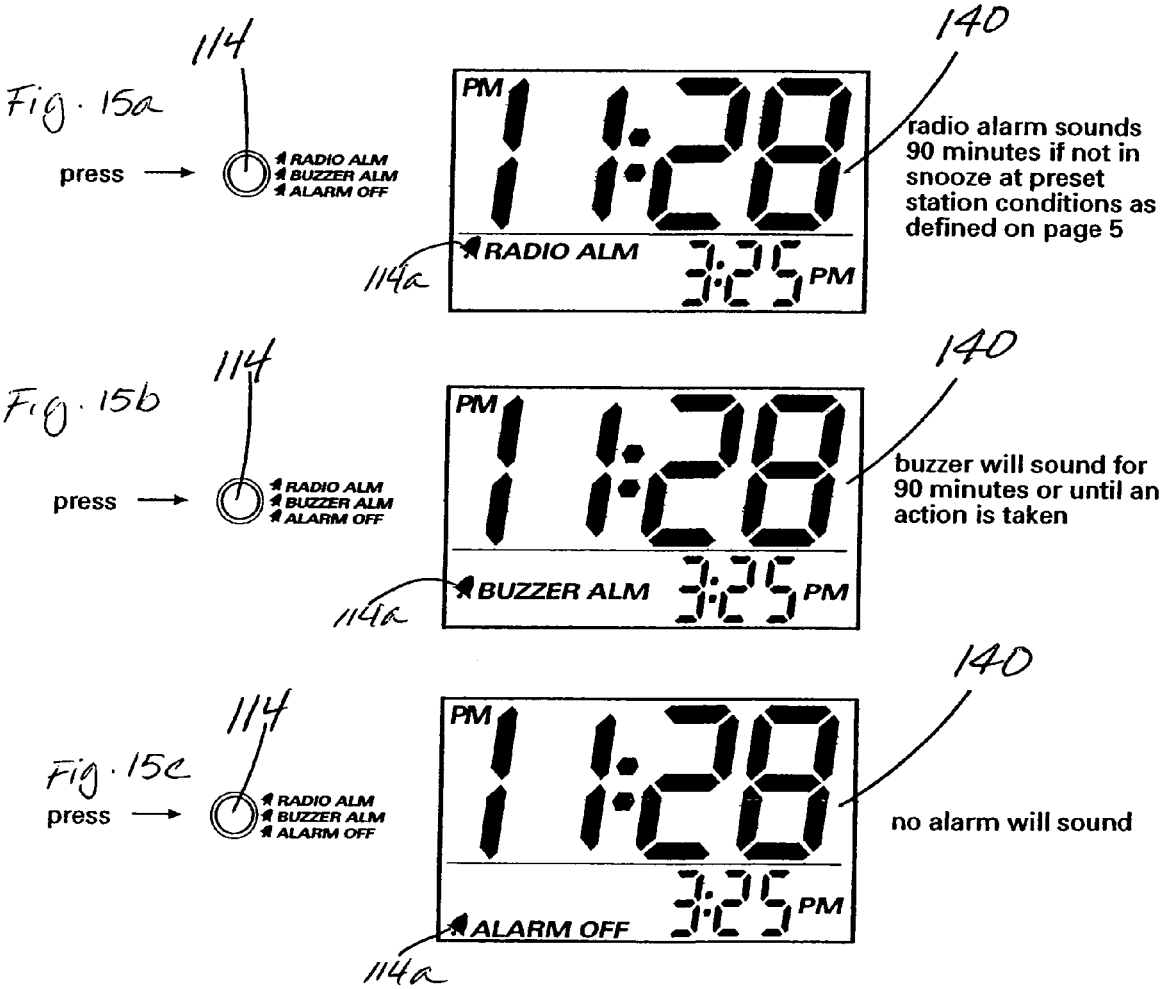

Stopping Alarm after alarm has gone off (in either radio or buzzer mode), pressing either of the following keys will deactivate the alarm:

Snooze Bar

NOTE: After alarm has gone off, alarm mode defaults to "ALARM OFF"

Clock Dimmer/ Night Light (optional)

Radio Tuning
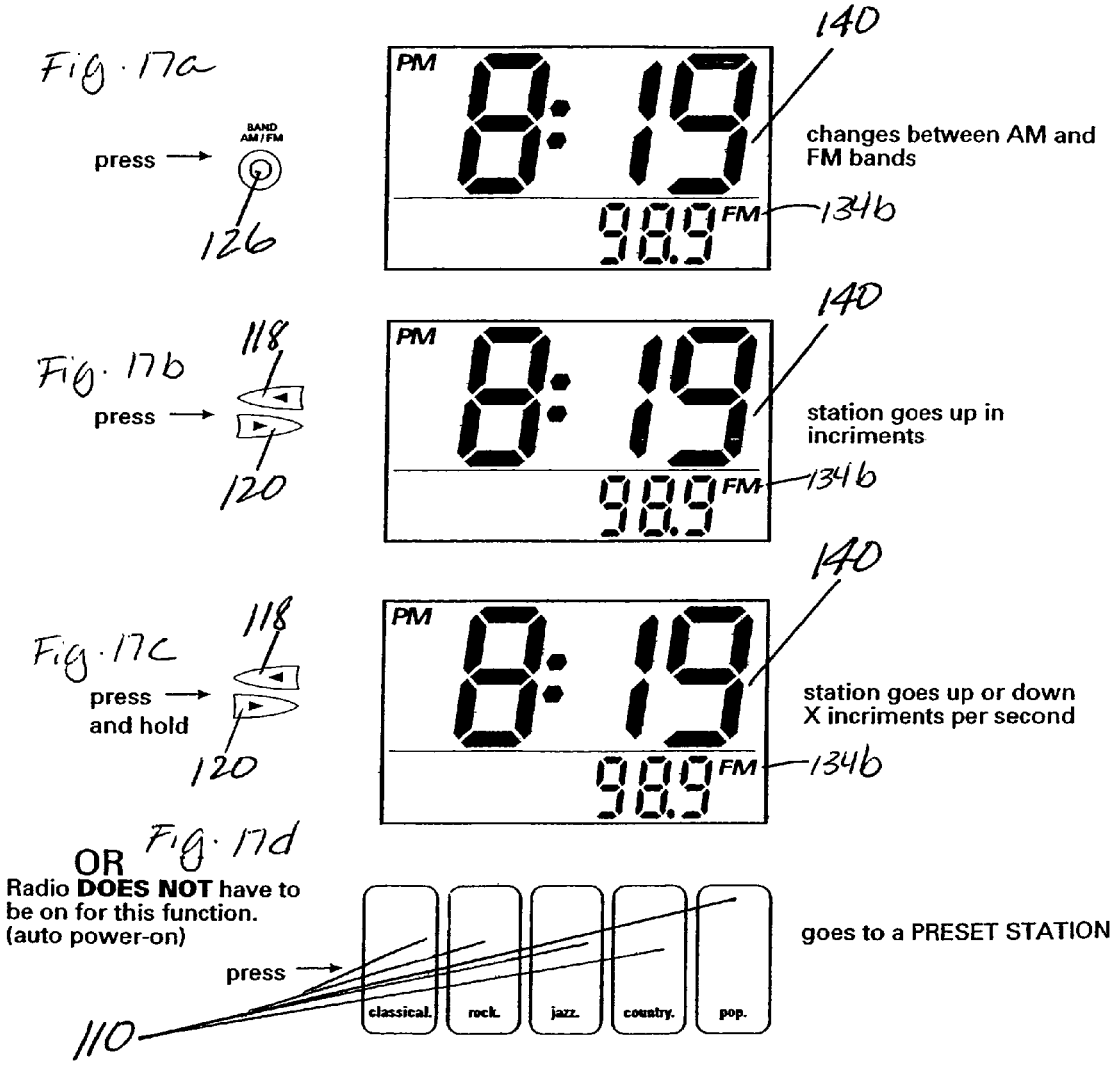

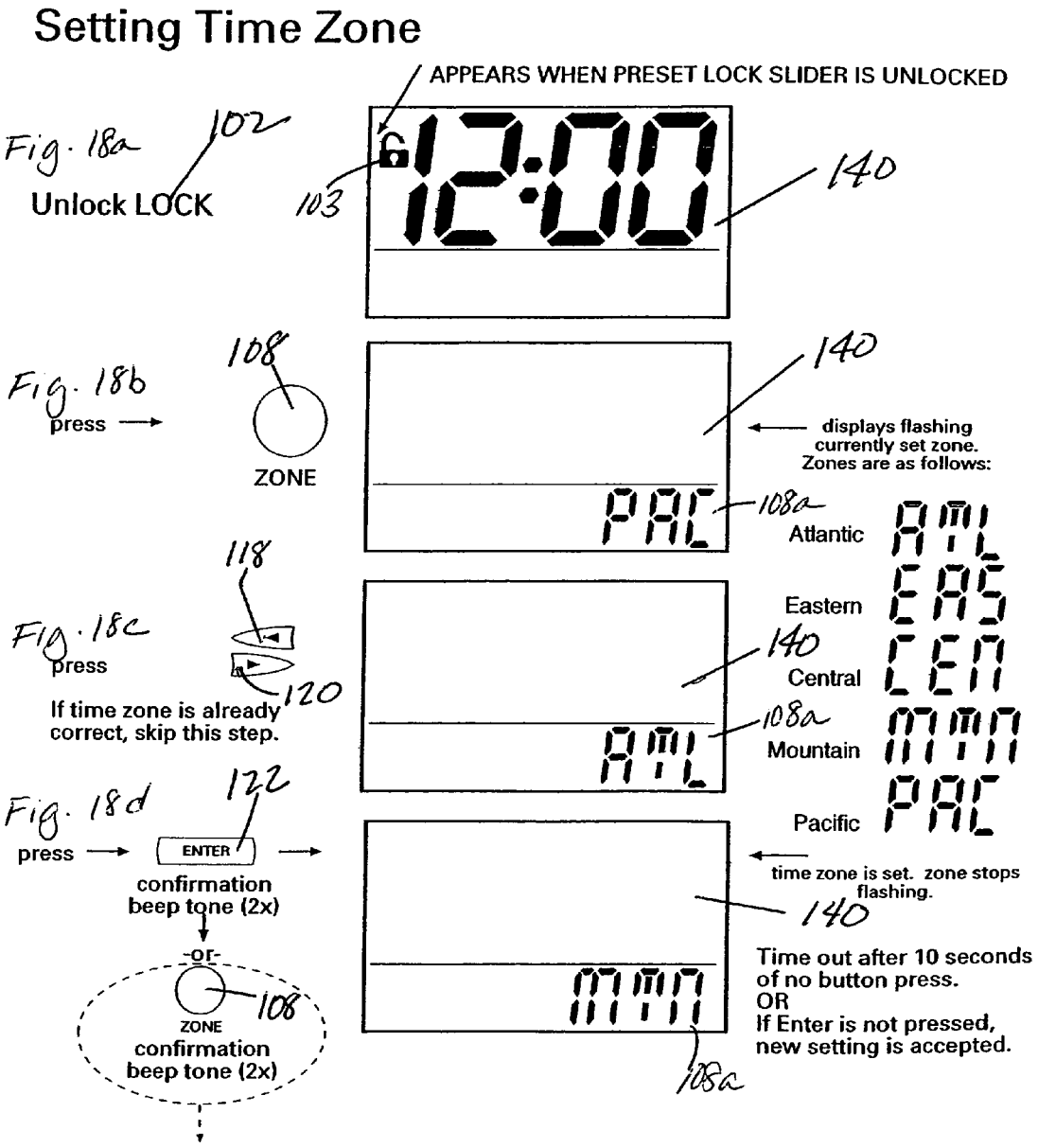
Setting Time Zone
APPEARS WHEN PRESET LOCK SLIDER IS UNLOCKED
Fig. 18a
102
Unlock LOCK
103
12:00
140
Fig. 18b
108
press
ZONE
140
displays flashing currently set zone. Zones are as follows:
PAC
108a
Atlantic AtL
Eastern EAS
Central CEN
Mountain MTN
Pacific PAC
118
Fig. 18c
press
120
If time zone is already correct, skip this step.
140
AtL
108a
Fig. 18d
122
press
ENTER
confirmation beep tone (2x)
-or-
108
ZONE
confirmation beep tone (2x)
time zone is set. zone stops flashing.
140
MTN
Time out after 10 seconds of no button press.
OR
If Enter is not pressed, new setting is accepted.
108a

500

220
230
050
140
200
210
HI276B LCD PORTION
ON/OFF

SINGLE DAY ALARM CLOCK

FIELD OF THE INVENTION

The present invention relates to a single day alarm clock. More particularly, the present invention relates to a single day alarm clock having the functionality of canceling alarm settings once an alarm has sounded and a method of using the same.

BACKGROUND OF THE INVENTION

Alarm clocks and the like having various designs, structures and configurations have been disclosed in the prior art. For example, U.S. Pat. No. 4,016,562 discloses a switch-off device for an electrically operated clock alarm and control thereof. An electrically operable alarm is provided for a clock and includes a clock operated switch for turning the alarm on at a selected time. A manual switch is provided which, when opened momentarily, will cause a bistable switching circuit to go to a second condition in which the alarm remains silent until the clock operated switch again closes the next day. The manual switch is adjustable for preventing the alarm from sounding when the clock operated switch closes. This prior art patent does not disclose or teach the design and configuration of a single day alarm clock of the present invention.

There are therefore situations in which it is undesirable for an alarm clock to go off every day at a previously set time. An example of such a situation is a hotel that provides alarm clocks in the rooms thereof for the use of hotel guests. When a hotel guest uses a hotel-provided alarm clock, the guest may not disarm the alarm before checking out of the hotel. Thus, unless a hotel employee or the next guest to stay in the room disarms the alarm, the alarm will sound the next day at the time set by the previous hotel guest. Therefore, a disadvantage of a conventional alarm clock is that a user, such as a new hotel guest, for example, may be undesirably awakened when the alarm sounds at a time set by a previous user.

Another disadvantage of conventional alarm clocks is the inability to effectively prevent altering settings thereof, such as the time, for example.

SUMMARY OF THE INVENTION

The present invention is therefore directed to a single day alarm clock and a method of using the same, which substantially overcome one or more of the problems due to the limitations and disadvantages of the related art.

In an effort to provide these and other features and advantages of the present invention, a single day alarm clock is provided that sounds an alarm at a preset alarm time, and that, after the alarm has sounded, automatically sets an alarm-off mode to prevent sounding of the alarm at the preset alarm time again the next day or thereafter until reset by the user.

Also provided is a single day alarm clock having lockable settings so that changing of the lockable settings is restricted.

A method for using a single day alarm clock that sounds an alarm at a preset alarm time, and that, after the alarm has sounded, automatically sets an alarm-off mode to prevent sounding of the alarm again the next day or thereafter until reset by the user is also provided.

Further, a method for using and/or programming a single day alarm clock having lockable settings so that changing of the lockable settings is restricted, is provided.

It is therefore a feature of an embodiment of the present invention to provide a single day alarm clock including means for activating an alarm to sound at a selected time and means for automatically deactivating the alarm after the alarm has sounded.

It is another feature of an embodiment of the present invention to provide a single day alarm clock including means for setting a current time of the single day alarm clock, means for setting an alarm mode of the single day alarm clock to one of an alarm-on mode and an alarm-off mode, means for setting an alarm time at which an alarm will sound when the alarm mode is set to the alarm-on mode, and means for automatically setting the alarm mode to the alarm-off mode upon sounding of the alarm in the alarm-on mode.

It is another feature of an embodiment of the present invention to provide a single day alarm clock including a plurality of buttons for setting a current time, an alarm time, and an alarm mode of the single day alarm clock, circuitry for causing an alarm to sound at the set alarm time when the set alarm mode is an alarm-on mode, circuitry that prevents the alarm from sounding when the set alarm mode is an alarm-off mode, and circuitry for automatically setting the alarm mode to the alarm-off mode once the alarm has sounded in the alarm-on mode.

It is yet another feature of an embodiment of the present invention to provide a programmable single day alarm clock including a plurality of buttons for programming settings of the single day alarm clock, the settings including a current time, which, when set, dynamically keeps time, an alarm time, which, when set, is constant, and an alarm mode, the alarm mode including at least an alarm-on mode and an alarm-off mode, wherein, when the programmed alarm mode setting is the alarm-on mode, an alarm sounds when the current time advances to the programmed alarm time setting, and means for automatically reprogramming the alarm mode setting to the alarm-off mode once the alarm has sounded in the alarm-on mode.

A single day alarm clock of the present invention may further include audio means, such as an MP3 player or radio receiver. For example, audio means, such as a radio receiver, receives AM and FM band radio broadcasts and comprises a band selector for selecting either the AM band or FM band, a tuner for selecting a particular radio station in the selected band, and a plurality of programmable radio preset buttons for being programmable to selected radio stations, and with the alarm-on mode setting being selectable between a radio mode and a buzzer mode to sound a selected radio station or a buzzer as the alarm, as desired.

A single day alarm clock of the embodiments of the present invention may further include a display, such as, for example, an LCD or LED, for displaying information including a current time, a time zone button for programming the single day alarm clock to display a current time of a selected time zone and means for automatically adjusting the displayed time to compensate for a change in time due to daylight savings time.

Further, a single day alarm clock of the embodiments of the present invention may include a calendar button for displaying a current date, calendar buttons for setting a year, month and day of the current date, leap year adjusting means for automatically adjusting the current date to compensate for leap year with the leap year adjusting means adding an additional day to a second month every four years.

It is a feature of an embodiment of the present invention to provide a locking switch for preventing changing lockable settings of the single day alarm clock. The lockable settings may include any of a current date, a current time, preset button settings and a time zone setting. The single day alarm clock of an embodiment of the present invention may include additional lockable settings. In an embodiment of the present invention, the locking switch and buttons specific to setting or programming the lockable settings of the single day alarm clock may be concealed by a removable cover.

It is yet another feature of an embodiment of the present invention to provide a method for programming settings of a single day alarm clock to sound a chosen alarm one time and then deactivating the alarm, the single day alarm clock comprising a locking switch for locking programmed settings thereof, audio means comprising a tuner for receiving a selected radio station and a plurality of programmable preset buttons being set with a selected radio station, a time zone switch allowing selection of a particular time zone and means for automatically deactivating the alarm after the alarm has sounded, the method comprising moving the locking switch to a setting-unlock position, selecting a time zone by the time zone switch, setting an alarm-sounding time, setting a type of alarm to sound at the set alarm-sounding time, and automatically deactivating the alarm after the alarm has sounded one time wherein, if the set type of alarm is a radio alarm, selecting a radio station as the alarm by pressing a radio preset button, and moving the locking switch to a setting-lock position.

By the various embodiments of the present invention, a single day alarm clock and a method for using the same are provided in which an alarm setting is automatically deactivated after the alarm has sounded, such that the alarm does not sound again the next day or thereafter until the alarm setting is set again. The embodiments of the present invention further provide a locking feature, whereby lockable settings of a single day alarm clock are prevented from being changed and a method for using the same.

In addition, a single day alarm clock of the present invention is easy to set and to use and may be mass-produced in an automated and economical manner so as to be readily affordable to a user.

BRIEF DESCRIPTION OF THE DRAWINGS

The above and other features and advantages of the present invention will become more apparent to those of ordinary skill in the art by describing, in detail, exemplary embodiments thereof with reference to the attached drawings in which:

FIGS. 2*a*, 2*b*, 2*c* and 2*d* illustrate steps for setting a time of the single day alarm clock of FIG. 1 and exemplary conditions of a display while performing the steps;

FIGS. 4*a*, 4*b* and 4*c* illustrates steps for programming preset buttons of the single day alarm clock shown in FIG. 1 and exemplary conditions of a display while performing the steps and FIG. 4*d* illustrates the preset buttons of the single day alarm clock shown in FIG. 1;

FIGS. 5*a*, 5*b* and 5*d* illustrate steps for setting an alarm time of the single day alarm clock of FIG. 1 and exemplary conditions of a display while performing the steps and FIG. 5*c* illustrates the preset buttons of the single day alarm clock shown in FIG. 1;

FIGS. 8*a*, 8*b* and 8*c* illustrate steps for turning on and tuning a radio of the single day alarm clock shown in FIG. 1 and exemplary conditions of a display while performing the steps and FIG. 8*d* illustrates the preset buttons of the single day alarm clock shown in FIG. 1;

FIGS. 10*a*, 10*b* and 10*c* illustrate steps for setting a time of the single day alarm clock shown in FIGS. 9*a* and 9*b* and exemplary conditions of a display while performing the steps;

FIGS. 11*a*, 11*b*, 11*c*, 11*d* and 11*e* and FIGS. 12*a* and 12*b* illustrate steps for setting a date of the alarm clock shown in FIGS. 9*a* and 9*b* and exemplary conditions of a display while performing the steps;

FIGS. 13*a*, 13*b* and 13*c* illustrate steps for programming radio preset buttons of the single day alarm clock shown in FIGS. 9*a* and 9*b* and exemplary conditions of a display while performing the steps and FIG. 13*d* illustrates the preset buttons of the single day alarm clock shown in FIG. 9*a;*

FIGS. 14*a*, 14*b* and 14*d* illustrate steps for setting an alarm time of the single day alarm clock shown in FIGS. 9*a* and 9*b* and exemplary conditions of a display while performing the steps and FIG. 14*c* illustrates the preset buttons of the single day alarm clock shown in FIG. 9*a;*

FIGS. 15*a*, 15*b* and 15*c* illustrate steps for setting an alarm mode of the single day alarm clock shown in FIGS. 9*a* and 9*b* and exemplary conditions of a display while performing the steps;

FIGS. 17*a*, 17*b* and 17*c* illustrate steps for turning on and tuning a radio of the single day alarm clock shown in FIGS. 9*a* and 9*b* and exemplary conditions of a display while performing the steps and FIG. 17*d* illustrates the preset buttons of the single day alarm clock shown in FIG. 9*a;*

FIGS. 18*a*, 18*b*, 18*c* and 18*d* illustrate steps for setting a time zone of the single day alarm clock shown in FIGS. 9*a* and 9*b* and exemplary conditions of a display while performing the steps.

DETAILED DESCRIPTION OF THE INVENTION

Figure 1:
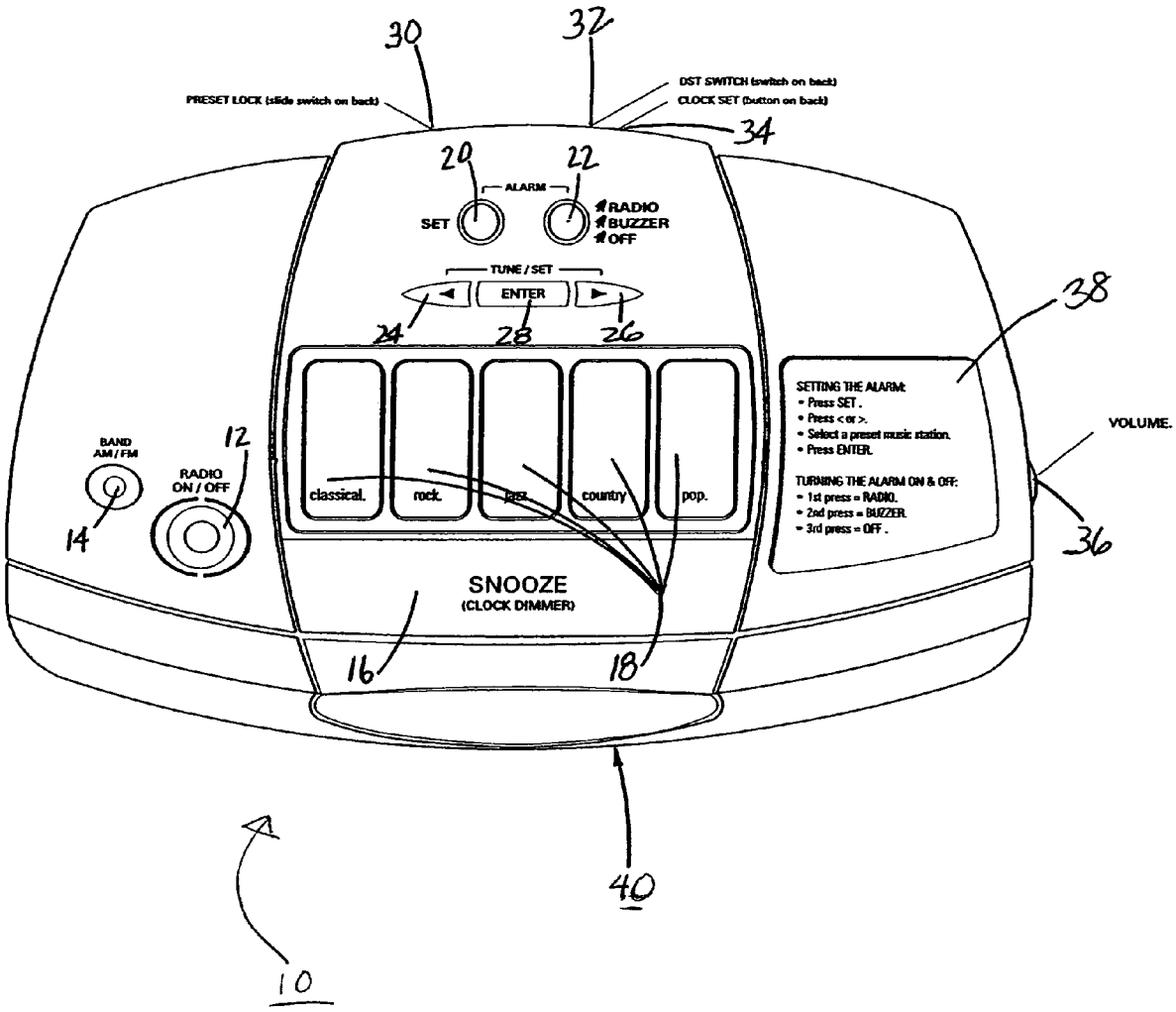
FIG. 1 illustrates a top perspective view of a single day alarm clock of an embodiment of the present invention.

The present invention will now be described more fully with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, like reference numerals refer to like elements throughout.

FIG. 1 shows a single day alarm clock 10 of an embodiment of the present invention. The single day alarm clock 10 is interchangeably referred to hereinafter as "the unit 10," "the clock 10" and the "single day alarm clock 10."

As shown in FIG. 1, the single day alarm clock 10 has a built in audio means (e.g., AM/FM radio (not shown)), an on/off button 12, an AM/FM button 14, a snooze bar 16, a plurality of preset buttons 18, alarm buttons 20 and 22, up/down buttons 24 and 26, and an enter button 28. A locking switch 30, a Daylight Savings Time (DST) switch 32 and a clock set switch 34 are provided on the back of the unit 10, and a volume button 36 is provided on a side thereof. It should be noted that the locking switch 30, DST switch 32, and clock set switch 34 may be provided as switches, buttons or any other suitable means, and the volume button 36 may be a dial, for example, instead of a button.

The unit 10 is housed in a suitable material, such as molded plastic, steel, etc., and further includes a display 40, such as, for example, a liquid-crystal display (LCD) or light emitting diode (LED), in the front portion of the housing. Simplified instructions for operating features of the single day alarm clock are provided on an instruction panel 38. The instruction panel 38 may be a portion of the housing, an adhesive panel, or any other suitable material, and the instructions may be printed in a contrasting color (such as white letters on a black housing, for example), or they may be etched into the housing.

The locking switch 30 is used to prevent particular settings of the alarm clock from being changed. For example, when the locking switch 30 is in the "on" or "locked" position, access to the clock's time-set and preset button-programming functions are restricted. Thus, the current time and the preset button settings cannot be changed, accidentally or otherwise, when the locking switch 30 is locked.

In an embodiment of the present invention, the locking switch 30 is used to restrict access to additional clock functions, such as an alarm time, an alarm mode, display brightness, etc., so that these settings cannot be accidentally changed.

FIGS. 2*a*-2*d* illustrate steps for setting a time of the single day alarm clock of FIG. 1, along with exemplary conditions of the display 40 during performance of the time-setting steps.

Figure 3:
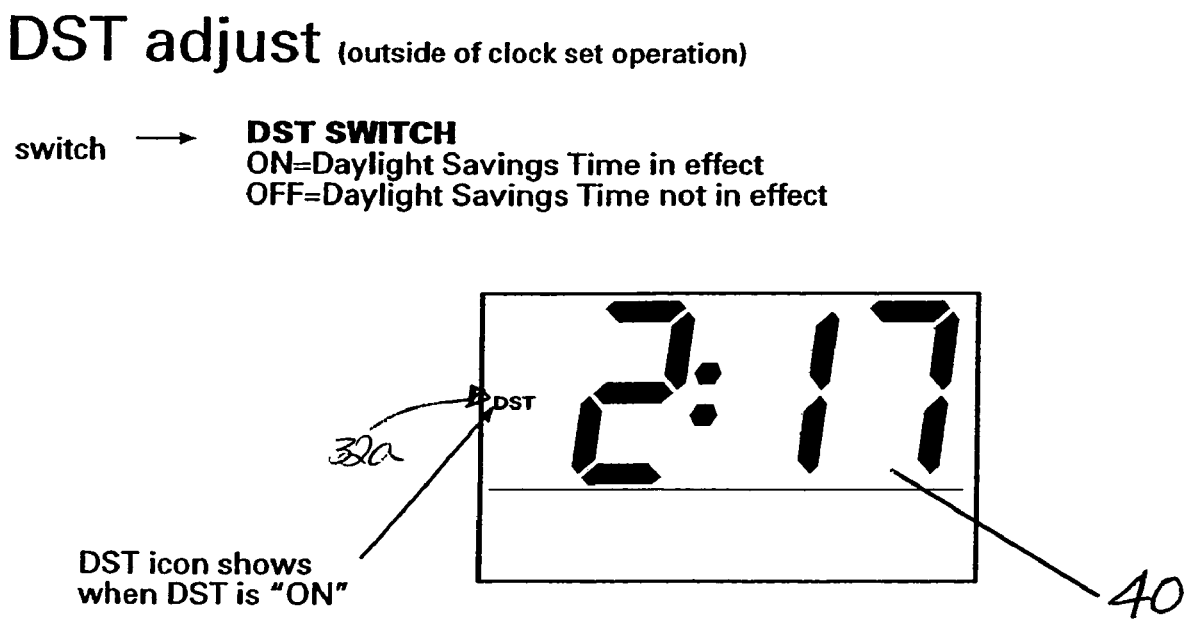
FIG. 3 illustrates a step for adjusting the daylight savings time (DST) of the single day alarm clock of FIG. 1 and an exemplary condition of a display while performing the step.

As shown in FIGS. 2*a*-2*d*, the time of the single day alarm clock 10 may be set by first unlocking the locking switch 30 by sliding the switch to the "off" or "unlocked" position. Unlocking the locking switch 30 allows unrestricted access to all of the clock's functions. When the locking switch 30 is in the "off" or "unlocked" position, an unlock icon 30*a* appears on the display 40. When the locking switch 30 is unlocked, pressing the clock set button 34 causes the clock to enter a clock setting mode. Either a currently set time or a default time, e.g., 12:00 AM, flashes on the display 40 when the clock 10 is in the clock setting mode. As shown in FIGS. 2*b* and 2*c*, the DST switch 32 may be toggled (pressed) at this time to turn on/off a Daylight Savings Time (DST) icon 32*a*. The DST icon 32*a* is displayed when Daylight Savings Time (DST) is in effect. As shown in FIG. 3, adjustment can also be made of this DST feature outside of the clock setting operation.

Next, while the clock 10 is in the clock setting mode, pressing one of the up/down buttons 24 and 26 causes the displayed time to be reversed or advanced, respectively, by one minute. Holding down one of the up/down buttons 24 and 26 causes the displayed time to be reversed or advanced rapidly, at a rate of X minutes per second, where X is factory set. When the correct time is displayed on the display 40, either of the enter button 28 or the clock set button 34 may be pressed to cause the currently displayed time to be programmed as the current clock time. When the enter button 28 or clock set button 34 is pressed, the clock 10 emits a confirmation tone, such as a beep or a series of beeps, to confirm that the clock 10 has been set to the new time. Alternately, once the time has been changed, if no button is pressed (e.g., the enter button 28, the clock set button 34 or the up/down buttons 24 and 26) within a predetermined time interval, e.g., 10 seconds, the clock 10 may automatically accept the new time settings. The locking button 30 may be switched back to the "locked" or "on" position at this time so that the newly set time cannot be changed unless the locking button 30 is unlocked.

The single day alarm clock 10 displays a "PM" icon 34*a*, as shown, for example, in FIG. 5, when the displayed time is PM.

FIGS. 4*a*-4*c* illustrate steps for programming the preset buttons 18 of the clock 10 and exemplary conditions of the display 40 during the programming operation.

The locking switch 30 should be moved to the unlock position to allow access to the preset button programming feature of the clock 10. When the locking button 30 is unlocked, the unlock icon 30*a* appears on the display 40. Pressing the radio on/off button 12 turns the radio on or off. With the radio on, the AM or FM band may be selected by toggling the AM/FM band button 14 until the desired band is chosen. An AM or FM icon 14*a* is displayed on the display 40 according to the selected band. Pressing the up/down buttons 24 and 26 decreases and increases the selected radio frequency, respectively. The currently selected radio frequency 12*a* is displayed on the display 40 next to the AM or FM icon 14*a*. When a desired radio frequency (station) has been reached, pressing and holding a particular preset button 18 causes the selected frequency (station) to be assigned to the particular preset button 18. The clock 10 emits a confirmation tone, such as a beep or a series of beeps, to confirm that a preset button 18 has been programmed with a selected radio station. The programming procedure described above may be repeated to program each of the preset buttons 18 with a desired radio station as shown in FIG. 4*d*. Sliding the locking switch 30 back to the "on" or "locked" position disables access to the clock's preset button programming feature so that the preset button programming cannot be changed.

FIGS. 5*a*-5*d* illustrate steps for setting an alarm time of the single day alarm clock 10 of FIG. 1 and a condition of the display 40 during the alarm-setting steps. The locking switch 30 may be in either the locked or unlocked position to access the alarm setting mode of the single day alarm clock 10. Pressing the alarm set button 20, shown in FIG. 5*a*, causes the single day alarm clock 10 to enter into the alarm setting mode. Since the single day alarm clock 10 of the present invention resets the alarm clock settings each time the alarm sounds, the alarm clock settings may automatically revert to default settings, and the alarm mode is switched to "alarm off." Thus, upon entry of the clock 10 into the alarm setting mode, either a previously set alarm time, or a default alarm time of 6:00 AM, for example, as shown in FIG. 5*a*, flashes on the display 40 below a current time. For example as shown in FIGS. 5*a*, 5*b* and 5*d*, the current time is 12:32 PM.

While the clock 10 is in the alarm setting mode, pressing the up/down buttons 24 and 26 causes the alarm time to decrease or increase, respectively, by one minute. Holding down the up/down buttons 24 and 26 causes the alarm time to decrease or increase rapidly, by X minutes per second. The changing alarm time is displayed on the display 40 below the current time, along with an AM or PM indicator 34*b*. For example as shown in FIG. 5*b*, the flashing alarm time is 6:38 AM. Once a desired alarm time (or "wake-up time" or "set time") has been reached, such as 6:38 AM as shown in FIG. 5*b*, pressing a preset button 18, shown in FIG. 5*c*, sets an alarm mode to a radio mode and the radio station programmed to that preset button 18 will play functioning as the alarm set at the set alarm time.

Setting the alarm to sound at the selected alarm time, e.g., 6:38 AM, may be completed by pressing the enter button 28 or the alarm set button 20, shown in FIG. 5*d*. Upon pressing the enter button 28 or the alarm set button 20, a confirmation tone is sounded to confirm that the alarm time has been set to the selected time and the displayed alarm time ceases flashing. The set alarm time, e.g., 6:38 AM, is displayed on the display 40. The AM or PM indicator 34*b* is also displayed on the display 40 to indicate whether the set alarm time is AM or PM. If no preset button 18 is pressed before pressing the enter button 28 or the alarm set button 20, pressing the enter button 28 or the alarm set button 20 sets the alarm mode to a buzzer mode, and a buzzer sounds as the alarm at the set alarm time.

Figure 6A:
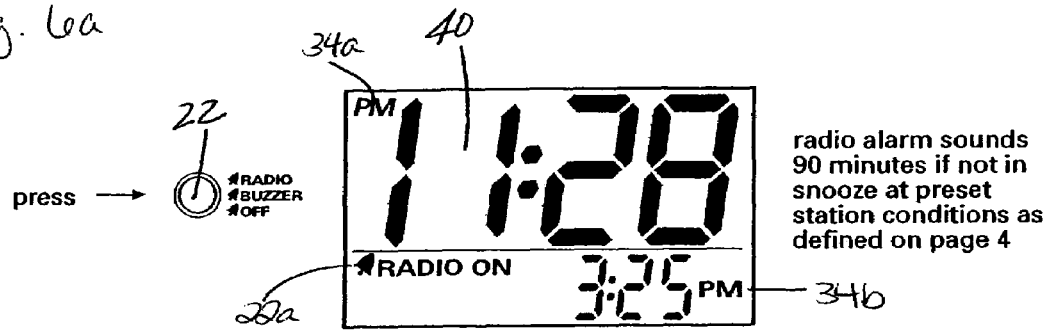
FIGS. 6*a*, 6*b* and 6*c* illustrate steps for selecting an alarm mode of the single day alarm clock of FIG. 1 and exemplary conditions of a display while performing the steps.
Figure 6B:
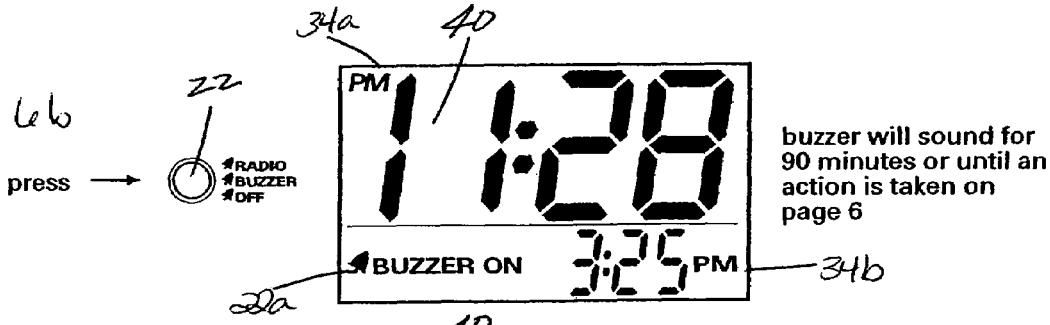
Figure 6C:
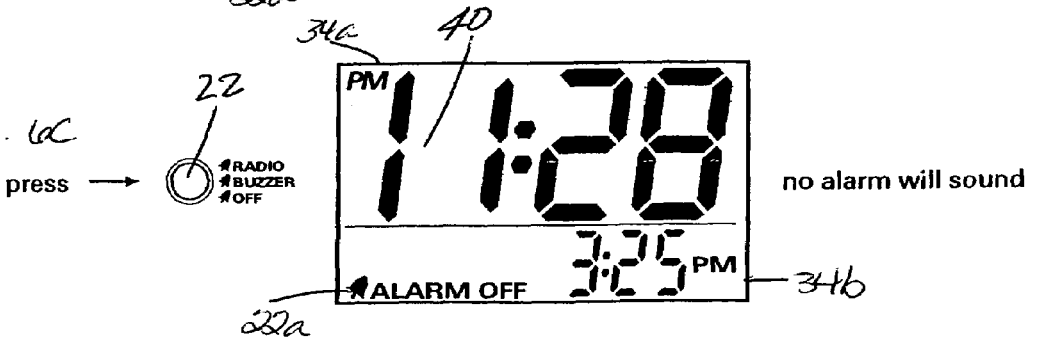

FIGS. 6*a*-6*c* illustrate alternate steps for selecting an alarm mode of the single day alarm clock 10 and exemplary conditions of the display 40 for different alarm modes. The alarm modes include at least an alarm-on mode and an alarm-off mode. The alarm-on modes comprises the radio mode and the buzzer mode, described above. In the alarm-off mode, an alarm does not sound. Pressing the alarm button 22 cycles through the alarm modes. For example, pressing the alarm button 22 once sets the radio mode, so that the radio plays at the set alarm time. Pressing the alarm button 22 twice sets the buzzer mode so that the buzzer sounds at the set alarm time. Pressing the alarm button 22 three times sets the alarm off mode so that no alarm sounds. An alarm mode icon 22*a* is displayed on the display 40 according to the selected alarm mode. FIGS. 6*a*-6*c* show exemplary alarm mode icons 22*a* for the radio mode, buzzer mode and alarm-off mode, respectively.

At the set alarm time, by default, the alarm (e.g., radio or buzzer) will sound for a predetermined period of time, such as, for example, 90 minutes. The alarm, however, may be stopped or temporarily stopped prior to the end of the default time period.

Figure 7A:
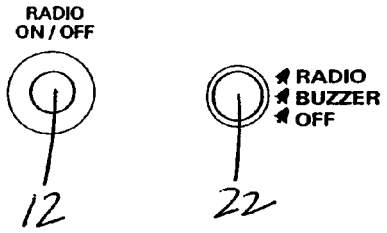
FIGS. 7*a*, 7*b* and 7*c* illustrate steps for stopping the alarm, operating a snooze bar and operating a clock dimmer/night light of the single day alarm clock shown in FIG. 1.
Figure 7B:
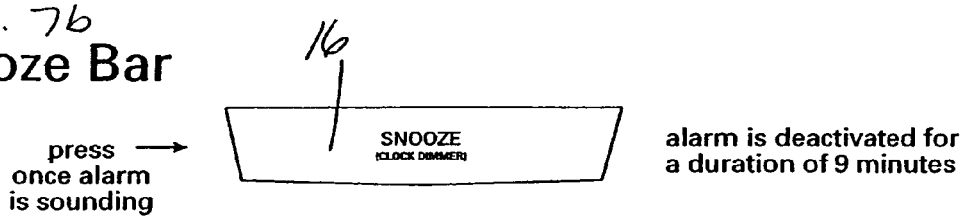
Figure 7C:
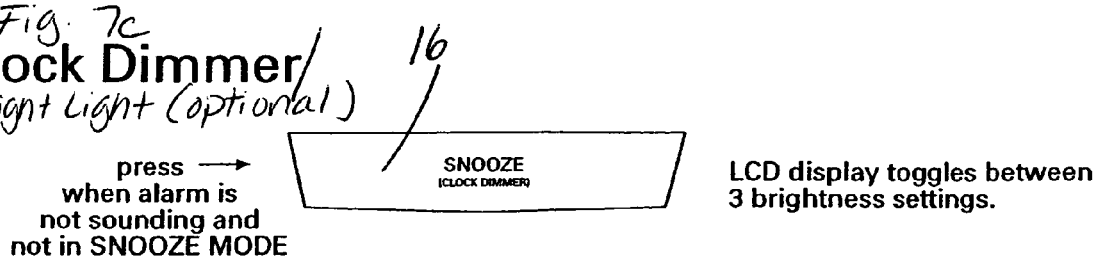

FIGS. 7*a*, 7*b* and 7*c* illustrate steps for stopping the alarm and for accessing a snooze function and a clock dimmer/night light function of the clock 10 with the snooze bar 16.

For example, once the alarm sounds, the alarm mode is automatically set to the alarm-off mode. However, the alarm continues to sound until it is stopped by pressing any of the snooze bar 16, the radio on/off button 12 and the alarm button 22. Pressing the snooze bar 16 of FIG. 7*b* temporarily stops the alarm so that the alarm sounds again after a predetermined "snooze" period of time, such as 9 minutes, for example. Pressing either the radio on/off button 12 or the alarm button 22 shuts of the alarm until the alarm is set to sound again. In an embodiment, the alarm may be set to sound again at the previously set alarm time by selecting an alarm-on mode by using the alarm button 22. Alternately, in another embodiment, the alarm time setting reverts to a default time when the alarm sounds and the alarm time may also be reset. In both embodiments, the alarm time may be reset at any time by following, for example, the alarm time setting steps above.

The snooze bar 16 of FIG. 7*c* may function as a clock dimmer control for setting a brightness of a backlight of the display 40. Pressing the snooze bar 16 when the alarm is not sounding and is not in "snooze mode" causes the display to toggle between different brightness settings. For example, the level of brightness of the display may be adjusted between three different levels, such as bright, brighter and brightest, by pressing the snooze bar 16 a corresponding number of times. There is also an optional night light setting for the snooze bar 16 with three brightness settings.

FIGS. 8*a*-8*c* illustrate two ways in which the radio of the single day alarm clock 10 of FIG. 1 may be turned on and steps for tuning the radio.

The radio 10 may be turned on by pressing the radio on/off button 12. In this case, the radio retains a previously tuned frequency (e.g., the radio frequency remains the same as the last time the radio was tuned). Alternately, the radio may be turned on by pressing a preset button 18. If the radio is turned on by pressing a particular preset button 18 as shown in FIG. 8*d*, the radio is automatically tuned to the frequency assigned to that particular preset button 18 when the radio turns on.

By a single day alarm clock of an embodiment of the present invention, settings for sounding an alarm are automatically canceled once the alarm has sounded, so that the alarm does not sound at a previously set time the following day and thereafter as such occurs when using a conventional alarm clock. Thus, when the single day alarm clock of the present invention is used in a hotel room, for example, a new guest is not subjected to the alarm clock settings, and consequent sounding of an alarm, of a previous guest.

A method of using the single day alarm clock 10 of FIG. 1 will now be described with respect to FIGS. 1-8.

For example, in a situation in which the single day alarm clock 10 of FIG. 1 is used in a hotel room, a maintenance person of the hotel may preset and lock certain settings of the clock. For example, the maintenance person may preset the time and radio preset buttons 18 in the manner described above and lock these settings with the locking switch 30.

The hotel may obtain in advance a list of preferred radio stations or music/news selections from a registered guest and set the radio preset buttons 18 to the preferred stations or stations broadcasting the preferred music/news selections prior to arrival of the registered guest, thus making the guest's stay at the hotel more enjoyable.

The preset buttons 18 may be labeled with the types of radio stations assigned thereto, such as jazz, country, news, etc., as shown in FIGS. 1, 4 and 8, so that a person using the radio can easily tune into a desired type of radio station. The preset button labels may be changeable, so that different labels may be used when different types of radio stations are programmed to the preset buttons 18. The preset labels may be adhesive. Alternately, the preset labels may be provided on a substrate such as paper, and the preset buttons 18 may include a removable clear cover for securing the preset labels thereunder.

A person using the single day alarm clock 10 may set the alarm in the manner described above and may select the brightness of the display 40 using the snooze button 16 as described with respect to FIGS. 7*a*-7*c*. By selecting the brightest setting for the display 40, one may effectively be provided with a night light. This can be advantageous for children, or in a situation in which a person must move about a darkened room during the night or early morning, particularly when the room is occupied by more than one person who may be, for example, trying to sleep.

Once the alarm of single day alarm clock 10 has sounded, the alarm settings are automatically canceled, and the alarm mode is automatically set to the alarm-off mode. Thus for example, when used in a hotel room, a new guest is not subjected to a previously set alarm time.

Figure 9A:
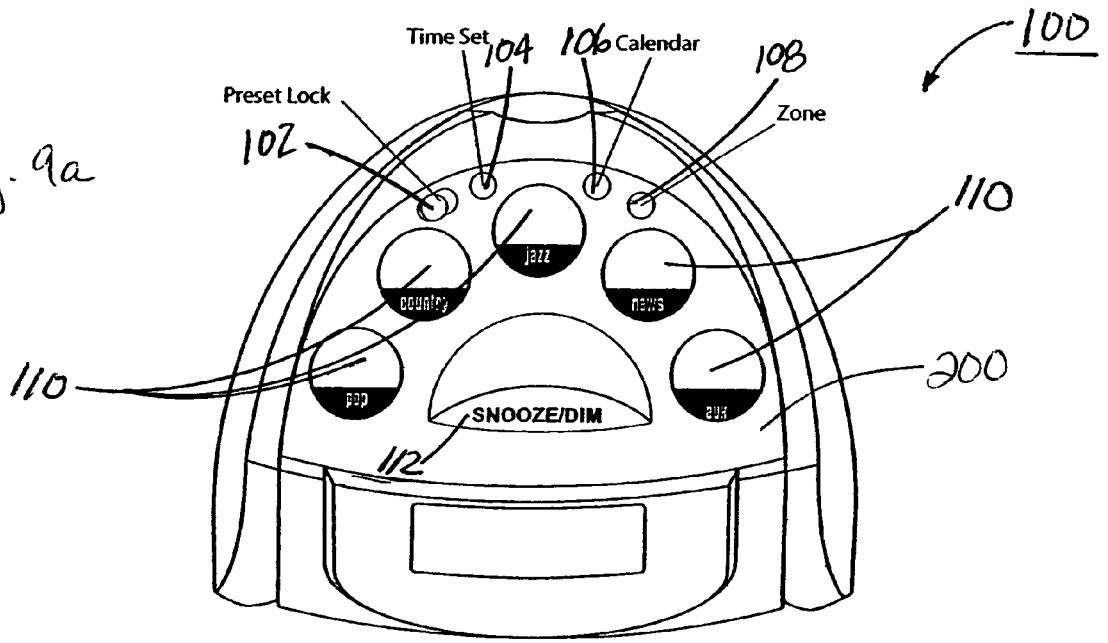
FIGS. 9*a* and 9*b* illustrate a top and front perspective view of a single day alarm clock of another embodiment of the present invention, respectively.
Figure 9B:
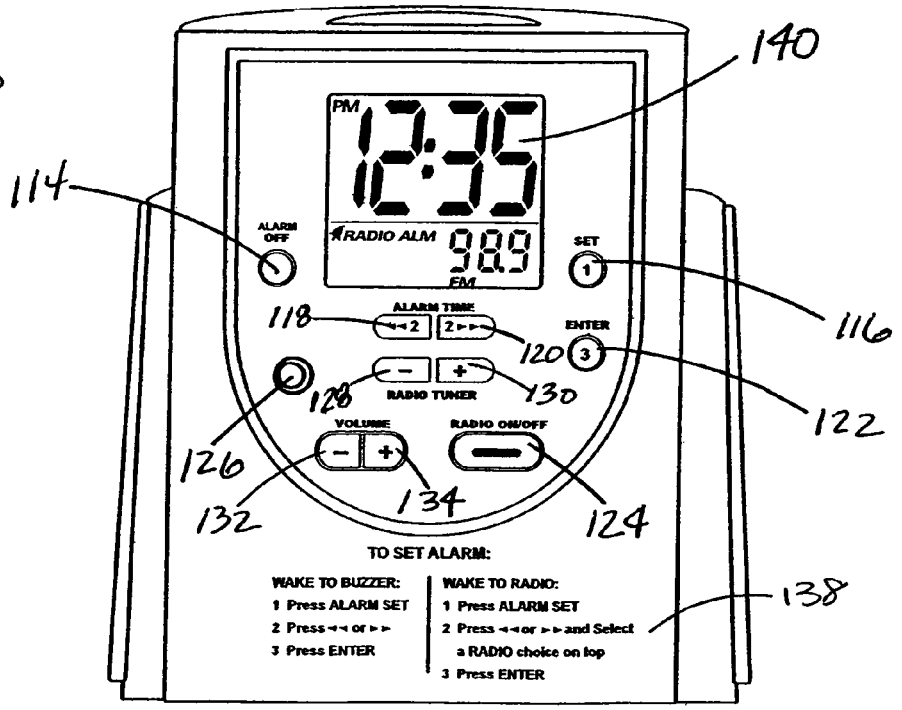
Figure 12A:
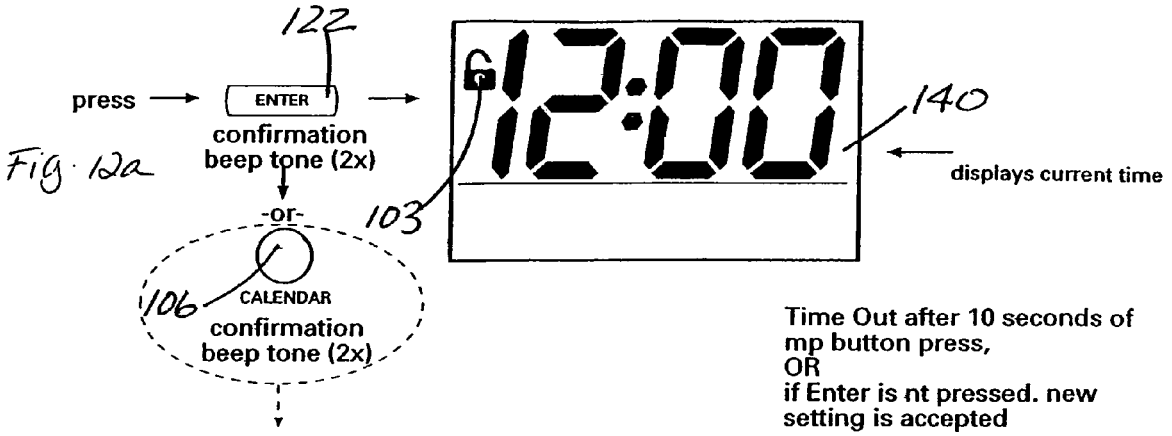
Figure 12B:
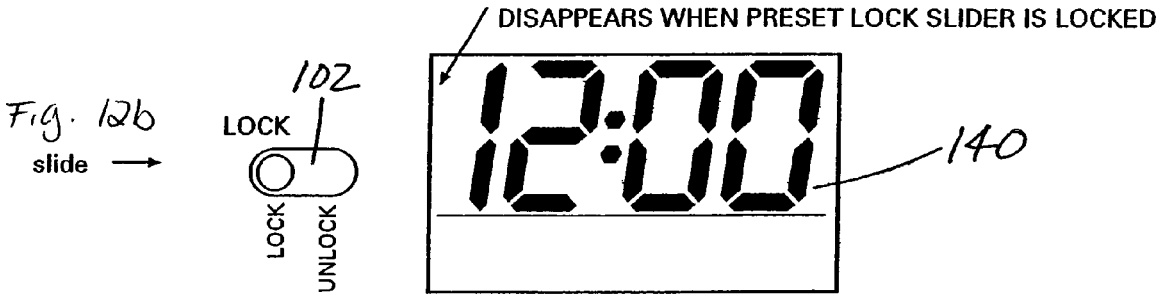

FIGS. 9*a* and 9*b* illustrate a single day alarm clock 100 of a second embodiment of the present invention. The single day alarm clock 100 is interchangeably referred to hereinafter as "the unit 100," "the clock 100" and "the single day alarm clock 100."

As shown in FIGS. 9*a* and 9*b*, the single day alarm clock 100 has a built in audio means (e.g., AM/FM radio (not shown)), a locking switch 102, a time set button 104, a calendar button 106, a time zone button 108, a plurality of preset buttons 110, a snooze/dimmer bar 112, an alarm-off button 114, an alarm set button 116, alarm time buttons 118 and 120, an enter button 122, a radio ON/OFF button 124, an AM/FM band button 126, radio tuner buttons 128 and 130, volume control buttons 132 and 134 and a display 140.

The locking switch 102, time set button 104, calendar button 106 and time zone button 108 may be provided as switches, buttons or any other suitable means.

The unit 100 is housed in a suitable material, such as molded plastic, steel, etc. The display 140 is provided in the front portion of the housing. Simplified instructions for operating features of the alarm are provided on an instruction panel 138. The instruction panel 138 may be a portion of the housing, an adhesive panel, or any other suitable material, and the instructions may be printed in a contrasting color (such as white letters on a black housing, for example), or they may be etched into the housing.

The locking switch 102 is used to prevent particular settings of the alarm clock from being changed. For example, when the locking switch 102 is in the "on" or "locked" position, access to the clock's time-set and preset button-programming functions are restricted. Thus, the current time and the preset button settings cannot be changed, accidentally or otherwise, when the locking switch 102 is locked.

In an embodiment of the present invention, a removable cover 200 is provided on the top of the unit 100. The removable cover 200 may be secured to the housing of the clock 100 with a screw or other suitable means. As previously described, in an embodiment of the present invention, lockable settings of the single day alarm clock, such as the current time, time zone, date, and/or settings of the radio preset buttons, may be changed only when the locking button is in the unlock position. In addition, changing such lockable settings, when the locking button 102 is in the unlock position, may require access to buttons specific to setting those features, such as the clock set button 116, the time zone button 108, and the calendar button 106, for example. Therefore, the locking button 102 and buttons specific to setting any or all of the lockable settings of the single day alarm clock 100 may be concealed beneath the removable cover 200. If the locking button 102 and other buttons specific to setting lockable settings of the single day alarm clock 100 are concealed beneath the removable cover 200, the lockable settings are less likely to be changed, by accident or otherwise, than if such buttons are not concealed.

For example, in an embodiment of the present invention, the locking button 102, clock set button 116, time zone button 108, and calendar button 106 shown in FIG. 9*a* are concealed beneath the removable cover 200. Thus, if the locking button 102 is in the locked position, the current time, time zone, date, and preset radio stations cannot be changed without removing, with the use of a screwdriver, for example, the cover 200, moving the locking button 102 to the unlocked position, and performing the remaining steps associated with programming each of the lockable settings described below. If the single day alarm clock 100 is used in a hotel room, for example, a guest of the hotel is not likely to disassemble the single day alarm clock 100 in order to change the locked settings thereof. If the time is correctly set, and the radio preset buttons are programmed with an acceptable variety of radio stations, a hotel guest should have no need to access the lockable settings of the single day alarm clock 100, since access to the other features of the single day alarm clock 100 are not concealed. Even with concealed setting buttons, a hotel guest (or other user) can easily listen to the radio, change a current radio band and/or station, adjust the radio volume, adjust a brightness of the display, set the alarm to go off at a desired time and to a desired type of alarm (e.g., a buzzer or a particular type of radio station), and prevent the alarm from going off if, after setting the alarm, the user decides the alarm will not be needed.

In another embodiment, the locking switch 102 and/or removable cover 200 may be used to restrict access to additional clock functions, such as an alarm time, an alarm mode, display brightness, etc., so that these settings cannot be accidentally changed.

It should be noted that a similar provision for concealing particular setting buttons may also be provided for the single day alarm clock 10 illustrated in FIGS. 1-8.

FIGS. 10*a*-10*c* illustrate steps for setting a time of the single day alarm clock 100 of FIGS. 9*a* and 9*b* along with exemplary conditions of the display 140 during performance of the time-setting steps.

As shown in FIG. 10*a*-10*c*, the time of the single day alarm clock 100 may be set by first unlocking the locking switch 102 by sliding the switch to the "off" or "unlocked" position. Unlocking the locking switch 102 allows unrestricted access to all of the clock's functions. When the locking switch 102 is in the "off" or "unlocked" position, an unlock icon 103 appears on the display 140. When the locking switch 102 is unlocked, pressing the clock set button 116 causes the clock to enter a clock setting mode. Either a currently set time or a default time, e.g., 12:00 AM, flashes on the display 140 when the clock is in the clock setting mode.

Next, while the clock is in the clock setting mode, pressing one of the up/down buttons 118 and 120 causes the displayed time to be reversed or advanced by one-minute intervals, respectively. Holding down one of the up/down buttons 118 and 120 causes the displayed time to be reversed or advanced rapidly, at a rate of X minutes per second, where X is factory set. When the correct time is displayed on the display 140, either of the enter button 122 or the clock set button 116 may be pressed to cause the currently displayed time to be programmed as the current clock time. When the enter button 122 or clock set button 116 is pressed, the clock emits a confirmation tone, such as a beep or a series of beeps, to confirm that the clock has been set to have the new time.

Alternately, once the time has been changed, if no button is pressed within a predetermined time interval, e.g., 10 seconds, the clock may automatically accept the new time settings. The locking button 102 may be switched back to the "locked" or "on" position at this time, so that the newly set time cannot be changed unless the locking button 102 is unlocked. The single day alarm clock 100 displays a "PM" icon 134*a*, as shown in FIG. 13, when the displayed time is PM.

The single day alarm clock 100 further includes circuitry for automatically compensating for daylight savings time and leap year. The displayed clock time is automatically advanced one hour at the beginning of daylight savings time and set back one hour at the end of daylight savings time each year. A daylight savings time (DST) icon 131 is displayed on the display 140 when daylight savings time is in effect. The DST icon 131 is not displayed when daylight savings time is not in effect. Display of the DST icon 131 occurs automatically in accordance with the daylight savings time (DST) compensation circuitry.

FIGS. 11*a*-11*e* and 12*a* and 12*b* illustrate steps for programming a date of the single day alarm clock 100 using a calendar setting function. FIGS. 11*a*-11*e* and 12*a* and 12*b* further illustrate exemplary conditions of the display 140 during the date-programming operation.

As shown in FIG. 11*a*-11*e*, moving the locking switch 102 to the unlock position allows access to the calendar setting function of the clock 100. When the locking button 102 is unlocked, the unlock icon 103 appears on the display 140. Pressing the calendar button 106 causes the single day alarm clock 100 to enter into the calendar setting mode, and a year icon, along with a default or previously set two-digit year, flashes on the display 140. In FIG. 11*c* and 11*d*, the two-digit year is "04." While the year is flashing, pressing the up/down buttons 118 and 120 decreases or increases the displayed year, respectively. Once the desired year is displayed, pressing the calendar button 106 again causes a default or previously set month/day (e.g., 101, or 0101, for January 1st) to flash on the display 140. While the month/day is flashing, pressing the up/down buttons 118 and 120 decreases or increases the displayed month/day, respectively. The single day alarm clock of the present invention automatically compensates for leap year. Thus, if the current year is programmed as previously described, a 29th day will be included in the month/day display of the second month if it is a leap year. Once the desired month/day is displayed, pressing the enter button 122 or calendar button 106 causes the selected year, month and day to be programmed to the clock 100. A confirmation tone, e.g., a beep or a series of beeps, confirms setting of the calendar, and moving the locking switch 102 back to the locked position disables access to the calendar setting function so that the set date cannot be changed. The unlock icon 103 disappears from the display 140 when the locking switch 102 is locked.

FIG. 13 illustrates steps for programming the preset buttons 110 of the clock 100, along with exemplary conditions of the display 140 during the programming operation. The locking switch 102 should be moved to the unlock position to allow access to the preset button programming feature of the clock 100. When the locking button 102 is unlocked, the unlock icon 103 appears on the display 140. Pressing the radio on/off button 124 turns the radio on or off. With the radio on, the AM or FM band may be selected by toggling the AM/FM band button 126 until the desired band is chosen. An AM or FM icon 126*a* is displayed on the display 140 according to the selected band. Pressing the up/down buttons 118 and 120 decreases and increases the selected radio frequency, respectively. The currently selected radio frequency, such as 87.9 FM, 1010 AM, or 98.9 FM, as shown in FIG. 13, is displayed on the display 140 next to the AM or FM icon 126*a*. When a desired radio frequency (station) has been reached, pressing and holding a particular preset button 110 causes the selected frequency (station) to be assigned to the particular preset button 110. The clock 100 emits a confirmation tone, such as a beep or a series of beeps, to confirm that a preset button 110 has been programmed with a selected radio station. The programming procedure described above may be repeated to program each of the preset buttons 110 with a desired radio station. Sliding the locking switch 102 back to the "on" or "locked" position disables access to the clock's preset button programming feature so that the preset button programming cannot be changed.

FIGS. 14*a*-14*d* illustrate steps for setting an alarm time of the single day alarm clock 100 and exemplary conditions of the display 140 during the alarm-setting steps. The locking switch 102 may be in either the locked or unlocked position to access the alarm setting mode of the single day alarm clock 100. Pressing the alarm set button 116 causes the single day alarm clock 100 to enter into the alarm setting mode. Since the single day alarm clock 100 of the present invention resets the alarm clock settings each time the alarm sounds, the alarm clock settings may automatically revert to default settings, and a mode of the alarm ("alarm mode") is switched to an alarm-off mode. Thus, upon entry of the clock 100 into the alarm setting mode, either a previously set alarm time, or a default alarm time of 6:00 AM, for example, as shown in FIG. 14*a*, flashes on the display 140 below a current time, such as 12:32 PM, for example, as shown in FIGS. 14*a*, 14*b* and 14*d*.

While the clock 100 is in the alarm setting mode, pressing the up/down buttons 118 and 120 causes the alarm time to decrease or increase, respectively, by one minute. Holding down the up/down buttons 118 and 120 causes the alarm time to decrease or increase rapidly, by X minutes per second. The changing alarm time is displayed on the display 140 below the current time, along with an AM or PM indicator 134*b*. For example, in FIG. 14*b*, the flashing alarm time is 6:38 PM. Once a desired alarm time has been reached, such as 6:38 AM, as shown in FIG. 14*d*, pressing a preset button 110, shown in FIG. 14*c*, sets the radio station programmed to that preset button 110 as the alarm type that will sound at the set alarm time.

Setting the alarm to sound at the selected wake-up time, e.g., 6:38 AM, may be completed by pressing the enter button 122 or the alarm set button 116, as shown in FIG. 14*d*. Upon pressing the enter button 122 or the alarm set button 116, a confirmation tone is sounded to confirm that the alarm time has been set to the selected time, and the displayed alarm time ceases flashing. The set alarm time, e.g., 6:38 AM, is displayed on the display 140. The AM or PM indicator 134*b* is also displayed on the display 140, to indicate whether the set alarm time is AM or PM. If no preset button 110 is pressed before pressing the enter button 122 or the alarm set button 116, pressing the enter button 122 or the alarm set button 116 sets the alarm mode to a buzzer mode, and a buzzer sounds as the alarm at the set alarm time.

FIGS. 15*a*-15*c* illustrate alternate steps for selecting an alarm mode of the single day alarm clock 100, and exemplary conditions of the display 140 for different alarm modes. The alarm modes include at least an alarm-on mode and an alarm-off mode. The alarm-on modes comprises the radio mode and the buzzer mode, described above. In the alarm-off mode, an alarm does not sound. Pressing the alarm button 114 cycles through the alarm modes. For example, pressing the alarm button 114 once sets the radio mode so that the radio sounds at the set alarm time. Pressing the alarm button 114 twice sets the buzzer mode so that the buzzer sounds at the set alarm time. Pressing the alarm button 114 three times sets the alarm-off mode so that no alarm sounds. An alarm mode icon 114*a* is displayed on the display 140 according to the selected alarm mode. FIGS. 15*a*-15*c* show exemplary alarm mode icons 114*a* for the radio mode, buzzer mode and alarm-off mode, respectively.

At the set alarm time, by default, the alarm (e.g., radio or buzzer) will sound for a predetermined period of time, such as, for example, 90 minutes. The alarm, however, may be stopped or temporarily stopped prior to the end of the default time period.

Figure 16A:
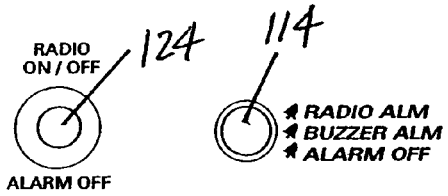
FIGS. 16*a*, 16*b* and 16*c* illustrate steps for stopping an alarm, operating a snooze bar and operating a clock dimmer/night light in the alarm clock shown in FIGS. 9*a* and 9*b;*
Figure 16B:
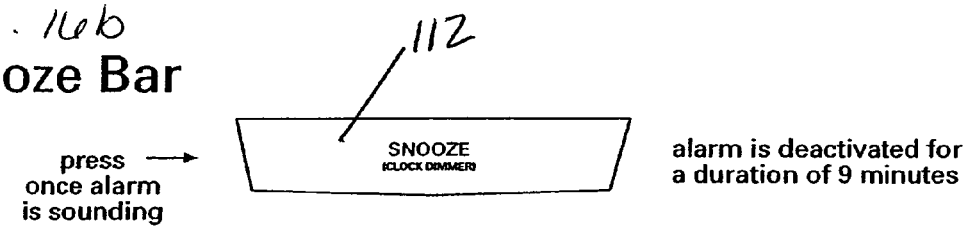
Figure 16C:
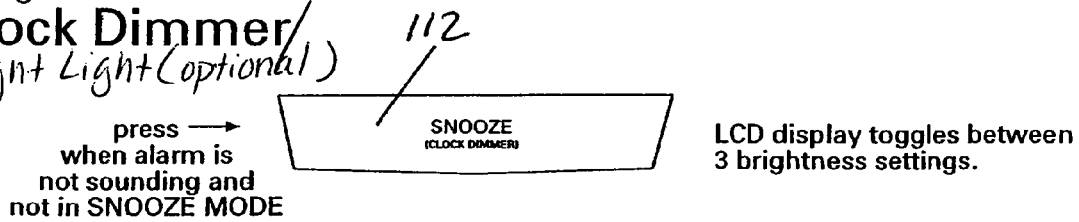

FIGS. 16*a*, 16*b* and 16*c* illustrate steps for stopping the alarm and for accessing a snooze function and a clock dimmer/night light function of the clock 100 with the snooze bar 112.

Once the alarm sounds, the alarm mode is automatically set to the alarm off mode. However, the alarm continues to sound until it is stopped by pressing any of the snooze bar 112, the radio on/off button 124 and the alarm button 114. Pressing the snooze bar 112 of FIG. 16*b* temporarily stops the alarm, so that the alarm sounds again after a predetermined "snooze" period of time, such as 9 minutes, for example. Pressing either the radio on/off button 124 or the alarm button 114 shuts of the alarm until the alarm is set to sound again. In an embodiment, the alarm may be set to sound again at the previously set alarm time by selecting an alarm-on mode by using the alarm button 114. Alternately, in another embodiment, the alarm time setting reverts to a default time when the alarm sounds, and the alarm time may also be reset. In both embodiments, the alarm time may be reset at any time by following the alarm time setting steps above.

The snooze bar 112 of FIG. 16*c* may also function as a clock dimmer control for setting a brightness of a backlight of the display 140. Pressing the snooze bar 112 when the alarm is not sounding and is not in "snooze mode" causes the display to toggle between different brightness settings. For example, the level of brightness of the display may be adjusted between three different levels, such as bright, brighter and brightest, by pressing the snooze bar 112 a corresponding number of times. There is also an optional night light setting for the snooze bar 16 with three brightness settings.

FIGS. 17*a*, 17*b* and 17*c* illustrates two ways in which the radio of the single day alarm clock 10 of FIGS. 9*a* and 9*b* may be turned on and steps for tuning the radio. The radio 100 may be turned on by pressing the radio on/off button 124. In this case, the radio retains a previously tuned frequency (e.g., the radio frequency remains the same as the last time the radio was tuned). Alternately, the radio may be turned on by pressing a preset button 110. If the radio is turned on by pressing a particular preset button 110 as shown in FIG. 17*d*, the radio is automatically tuned to the frequency assigned to that particular preset button 110 when the radio turns on.

In an embodiment of the present invention, the clock 100 is preset, at the factory, and delivered, with the current time for each of the seven time zones. The seven time zones are: Atlantic Standard, Eastern Standard, Central Standard, Mountain Standard, Pacific Standard, Alaska Standard and Hawaii Standard. When the time is factory set, the time zone button shows the current time of the selected time zone.

FIGS. 18*a*-18*d* illustrate steps for selecting a time zone of the clock 100 and conditions of the display 140 when setting the time zone. When the time zone button 108 of FIG. 18*b* is pressed, the clock 100 enters into a time zone select mode and a time zone icon 108*a* representing the currently programmed time zone flashes on the display 140. While the time zone icon 108*a* is flashing and the clock 100 is in the time zone select mode, pressing the up/down buttons 118 and 120, steps through the seven time zones, and, for each time zone, a time zone icon 108*a* representing that time zone, as well as the current time of that time zone, are displayed on the display 140.

Time zone icons 108*a* for the respective time zones may be, for example, ATL for Atlantic Standard, EAS for Eastern Standard, CEN for Central Standard, MTN for Mountain Standard, PAC for Pacific Standard, ALS for Alaska Standard and HAI for Hawaii Standard.

Once the desired time zone is displayed, pressing the time zone button 108 or the enter button 122 sets the clock 100 to that time zone, a confirmation tone is sounded and the time zone icon disappears from the display 140.

Figure 19:
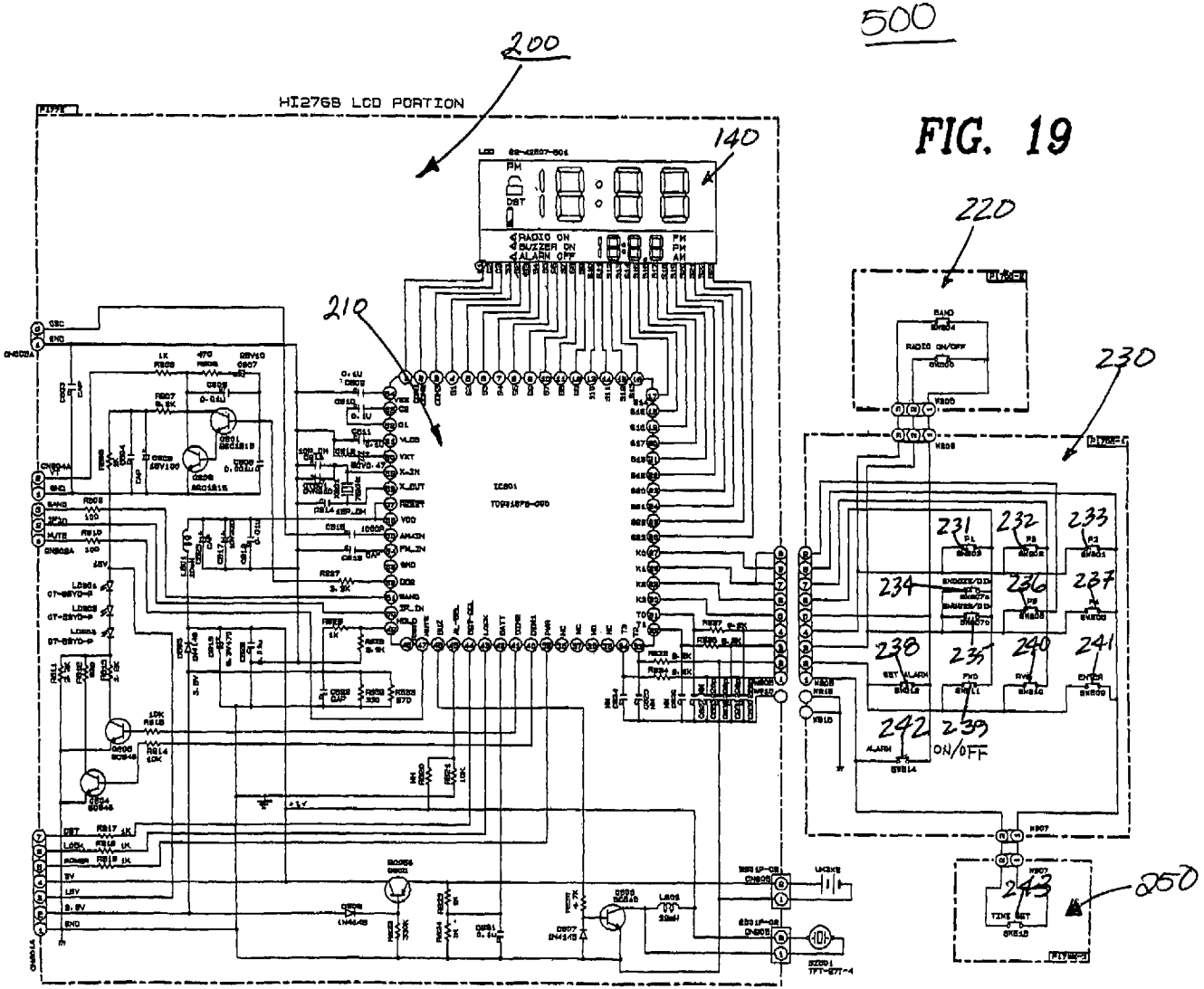
FIG. 19 illustrates a schematic block diagram of circuitry of a single day alarm clock of the present invention.

FIG. 19 illustrates an electrical schematic block diagram 500 showing circuitry of the single day alarm clock 100 in which circuit boards 200, 220, 230 and 250 and the display 140 are connected to a software and logic pc board 210. The circuit boards 220, 230 and 250 include multiple switches 231, 232, 233, 234, 235, 236, 237, 238, 239, 240, 241, 242 and 243 for setting the time of the clock and the alarm time, selecting a radio band, adjusting the display brightness, turning the radio on and off, setting the radio preset buttons and adjusting other settings of the single day alarm clock described herein. The circuit boards 220, 230 and 250 are electrically connected to the software and logic pc board 210 for controlling functions of switches 231 to 243.

The software in the software and logic pc board 210 controls the alarm so that after the alarm has sounded, the switch 242 is opened, thereby automatically changing the alarm mode to the alarm-off mode, so that the alarm is disarmed. Accordingly, the alarm does not sound the following day at the previously set alarm time, as normally occurs when using a conventional alarm clock. Thus, a person using the single day alarm clock is not subjected to the alarm settings of a previous user and/or the previous day.

A method of using the single day alarm clock 100 will now be described with respect to FIGS. 9*a*-19.

In the alarm clock 100 of the present invention, settings such as the time and date may be preset at a factory prior to shipping the alarm clock. Thus, when the alarm clock 100 is used in a hotel, for example, a hotel employee and a hotel guest may set the remaining settings according to, for example, a time zone in which the hotel is located, and musical preferences of a guest.

An employee of the hotel may preset and lock certain settings of the clock 100. For example, the employee may preset the radio preset buttons 110 and time zone in the manner described above with respect to FIGS. 17 and 18, and lock these settings with the locking switch 102 and the removable cover 200, if the clock is provided with the removable cover 200 shown in FIG. 9*a*.

The hotel may obtain in advance a list of preferred radio stations or music/news selections from a registered guest and set the radio preset buttons 110 to the preferred stations or stations broadcasting the preferred music/news selections prior to arrival of the guest, thus making the guest's stay at the hotel more enjoyable.

The preset buttons 110 may be labeled with the types of radio stations assigned thereto, such as jazz, country, news, etc., as shown in FIGS. 9*a* and 13*d*, so that a person using the radio can easily tune into a desired type of radio station. The preset button labels may be changeable, so that different labels may be used when different types of radio stations are programmed to the preset buttons 110. The preset labels may be adhesive. Alternately, the preset labels may be provided on a substrate such as paper, and the preset buttons 110 may include a removable clear cover for securing the preset labels thereunder.

A person using the single day alarm clock 100 may set the alarm in the manner described above with respect to FIGS. 14*a*-15*c*, and may select the brightness of the display 140 using the snooze button 112 as described with respect to FIG. 16. By selecting the brightest setting for the display 140, one may effectively be provided with a night light. This can be advantageous for children, or in a situation in which a person must move about a darkened room during the night or early morning, particularly when the room is occupied by more than one person who may be, for example, trying to sleep.

By a single day alarm clock of an embodiment of the present invention, settings for sounding an alarm are automatically canceled once the alarm has sounded, so that the alarm does not sound at a previously set time the following day, as occurs when using a conventional alarm clock. Thus, when the single day alarm clock of the present invention is used in a hotel room, for example, a new guest is not subjected to the alarm clock settings, and consequent sounding of the alarm, of a previous guest.

Other advantages of the present invention are that it provides for a single day alarm clock that can be mass produced in an automated and economical manner and is readily affordable by a user, and it is easy to use.

Exemplary embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A single day alarm clock, comprising:

means for setting a current time of the single day alarm clock;

means for setting an alarm mode of the single day alarm clock to one of an alarm-on mode and an alarm-off mode;

means for setting an alarm time at which an alarm will sound when the alarm mode is set to the alarm-on mode; and computing means including a processor in which software is stored, wherein the software enables the processor to automatically set the alarm mode to the alarm-off mode upon sounding of the alarm in the alarm-on mode, wherein in the alarm-off mode, the alarm is deactivated and alarm time settings are retained by the computing means.

2. The single day alarm clock as claimed in claim 1, further comprising locking means for restricting access to the means for setting the current time.

3. A single day alarm clock, comprising:

a plurality of buttons for setting a current time, an alarm time, and an alarm mode of the single day alarm clock;

circuitry for causing an alarm to sound at a set alarm time when the alarm mode is set to an alarm-on mode through at least one of the plurality of buttons;

circuitry that prevents the alarm from sounding when the alarm mode is set to an alarm-off mode through at least one of the plurality of buttons; and computing means including a setting function for automatically setting the alarm mode to the alarm-off mode once the alarm has sounded in the alarm-on mode without setting the setting function through at least one of the plurality of buttons, wherein in the alarm-off mode, the alarm is deactivated and alarm time settings are retained by the computing means.

4. The single day alarm clock as claimed in claim 3, further comprising a locking switch movable to allow or prevent setting of the current time.

5. A programmable single day alarm clock comprising:

a plurality of buttons for programming settings of the single day alarm clock, the programmed settings including a current time, which, when set, dynamically keeps time, an alarm time, which, when set, is constant, and an alarm mode, the alarm mode including at least an alarm-on mode and an alarm-off mode, wherein, when the programmed alarm mode setting is the alarm-on mode, an alarm sounds when the current time advances to the programmed alarm time setting; and computing means including a reprogramming function for automatically reprogramming the programmed alarm mode setting to the alarm-off mode once the alarm has sounded in the alarm-on mode without setting the reprogramming function through at least one of the plurality of buttons, wherein in the alarm-off mode, the alarm is deactivated and alarm time settings are retained by the computing means.

6. The single day alarm clock as claimed in claim 5, further comprising locking means for allowing or preventing programming of the current time.

7. A method for programming settings of a single day alarm clock, the method comprising the steps of:

activating an alarm by setting a time at which the alarm will sound;

selecting a type of the alarm to sound at the set time; and using computing means including a processor in which software is stored, wherein the software enables the processor to automatically deactivate the alarm after the alarm has sounded one time and retain alarm time settings.

8. A method for programming settings of a single day alarm clock, the method comprising the steps of:

moving a locking switch for locking programmed settings of the single day alarm clock to a setting-unlock position;

accessing a time function to set a current time based on the setting-unlock position of the locking switch;

accessing an alarm set function to activate an alarm by setting a time at which the alarm will sound and selecting a type of the alarm based on the setting-unlock position of the locking switch; and using computing means including a processor in which software is stored, wherein the software enables the processor to automatically deactivate the alarm after the alarm has sounded one time and retain alarm time settings.

9. A method for programming settings of a single day alarm clock, the method comprising the steps of:

moving a locking switch for locking programmed settings of the single day alarm clock to a setting-unlock position;

moving a time zone switch to select a time zone based on the setting-unlock position of the locking switch;

setting an alarm-sounding time to activate an alarm based on the setting-unlock position of the locking switch;

setting a type of alarm to sound at the set alarm-sounding time based on the setting-unlock position of the locking switch;

moving the locking switch to a setting-lock position; and using computing means including a processor in which software is stored, wherein the software enables the processor to automatically deactivate the alarm after the alarm has sounded one time and retain the set alarm-sounding time.

10. The method for programming settings of a single day alarm clock as claimed in claim 9, further comprising audio means for playing at least one selected audio setting.

11. The method for programming settings of a single day alarm clock as claimed in claim 10, wherein said audio means comprising a plurality of programmable preset buttons being set with selected audio settings, said setting step including selecting a selected audio setting as the alarm by pressing a preset button.

12. A single day alarm clock, comprising:

means for setting a current time of the single day alarm clock;

means for setting an alarm mode of the single day alarm clock to one of an alarm-on mode and an alarm-off mode;

means for setting an alarm time at which an alarm will sound when the alarm mode is set to the alarm-on mode;

means for automatically setting the alarm mode to the alarm-off mode upon sounding of the alarm in the alarm-on mode; and locking means for restricting access to the means for setting the current time, without restricting access to the means for setting the alarm time.

13. A single day alarm clock, comprising:

a plurality of buttons for setting a current time, an alarm time, and an alarm mode of the single day alarm clock;

circuitry for causing an alarm to sound at a set alarm time when the set mode is set to an alarm-on mode through at least one of the plurality of buttons;

circuitry that prevents the alarm from sounding when the alarm mode is set to an alarm-off mode through at least one of the plurality of buttons;

circuitry for automatically setting the alarm mode to the alarm-off mode once the alarm has sounded in the alarm-on mode; and a locking switch movable to allow or prevent setting of the current time without preventing setting of the alarm time.

14. A programmable single day alarm clock, comprising:

a plurality of buttons for programming settings of the single day alarm clock, the settings including a current time, which, when set, dynamically keeps time, an alarm time, which, when set, is constant, and an alarm mode, the alarm mode including at least an alarm-on mode and an alarm-off mode, wherein, when the programmed alarm mode setting is the alarm-on mode, an alarm sounds when the current time advances to the programmed alarm time setting;

means for automatically reprogramming the programmed alarm mode setting to the alarm-off mode once the alarm has sounded in the alarm-on mode; and locking means for allowing or preventing programming of the current time without preventing programming of the alarm time.

* * * * *